US006625952B1

(12) United States Patent
Chudy et al.

(10) Patent No.: US 6,625,952 B1
(45) Date of Patent: Sep. 30, 2003

(54) MEDICATION COLLECTING SYSTEM

(75) Inventors: Duane S. Chudy, Lincolnshire, IL (US); Shoji Yuyama, Toyonaka (JP); Shigeru Sugimoto, Toyonaka (JP)

(73) Assignee: AutoMed Technologies, Inc., Vernon Hills, IL (US)

( * ) Notice: Subject to any disclaimer, the term of this patent is extended or adjusted under 35 U.S.C. 154(b) by 117 days.

(21) Appl. No.: 09/702,441

(22) Filed: Oct. 26, 2000

Related U.S. Application Data

(63) Continuation of application No. 09/205,861, filed on Dec. 4, 1998, now Pat. No. 6,170,230.

(51) Int. Cl.[7] ..... B65B 19/18

(52) U.S. Cl. ..... 53/168; 53/531; 53/544; 221/129

(58) Field of Search ..... 53/493, 168, 238, 53/531, 544, 450; 221/73, 123, 129, 197

(56) References Cited

U.S. PATENT DOCUMENTS

| | | | |
|---|---|---|---|
| 3,556,342 | A | 1/1971 | Guerr |
| 3,917,045 | A | 11/1975 | Williams et al. |
| 3,998,356 | A | 12/1976 | Christensen |

(List continued on next page.)

FOREIGN PATENT DOCUMENTS

| | | |
|---|---|---|
| JP | 07-267370 | 3/1994 |
| JP | 09-51922 | 6/1996 |
| JP | 09-71530 | 3/1997 |
| JP | 10-149489 | 6/1998 |
| JP | 10-203749 | 8/1998 |
| JP | 09-142473 | 3/2000 |

OTHER PUBLICATIONS

Yuyama Mfg. Co., Ltd., "Yuyama Pharmaceutical Equipment General Catalog", date uncertain, possibly 1997 (see second page).

Yuyama Mfg. Co., Ltd., Additional pages from the Yuyama Mfg. Col., Ltd. catalog "vol. 5" previously identified on the Mar. 25, 1999 IDC showing an ampule dispenser.

Date: Not later than Dec. 3, 1997, probably 1995 (see highlighted dates).

Yuyama Mfg. Co., Ltd., Yuyama catalog, date uncertain, possibly 1995 (see second page).

Date: Not later than Dec. 3, 1997, probably 1995 or earlier.

ScriptPro–Pharmacy Automation, "Automated Prescription Dispensing System," Dec. 1995 copyright notice indicates date of 1996.

(List continued on next page.)

*Primary Examiner*—Eugene Kim

(74) *Attorney, Agent, or Firm*—Jansson, Shupe & Munger, Ltd

(57) ABSTRACT

A medication dispensing apparatus of the present invention contains a plurality of different kinds of medication separately, dispenses the medicament to pack them into package belt, and discharges the package belt. The medication dispensing apparatus comprises a cutting device for cutting the package belt into short package belt including at least one medication package for specified period in accordance with prescription data, a stacking device for stacking the short package belts and a bundling device for bundling the stacked short package belts. According to the medication dispensing apparatus, it is possible to cut off medication packages and empty packages from the package belt automatically and rapidly, reducing medication distributing job in a hospital. The medication dispensing apparatus is applicable to a medicament collecting system comprising a tray feed station, a medication dispensing station and a tray recovering station.

39 Claims, 23 Drawing Sheets

U.S. PATENT DOCUMENTS

| | | | | |
|---|---|---|---|---|
| 4,360,125 | A | | 11/1982 | Martindale et al. |
| 4,546,901 | A | | 10/1985 | Buttarazzi |
| 4,664,289 | A | | 5/1987 | Shimizu et al. |
| 4,733,362 | A | | 3/1988 | Haraguchi |
| 4,847,764 | A | | 7/1989 | Halvorson |
| 4,870,799 | A | | 10/1989 | Bergerioux et al. |
| 4,903,861 | A | | 2/1990 | Yuyama |
| 4,972,657 | A | | 11/1990 | McKee |
| 5,014,875 | A | | 5/1991 | McLaughlin et al. |
| 5,097,652 | A | | 3/1992 | Inamura et al. |
| 5,108,005 | A | | 4/1992 | Moshbacher |
| 5,208,762 | A | | 5/1993 | Charhut et al. |
| 5,233,813 | A | | 8/1993 | Kenny et al. |
| 5,253,783 | A | | 10/1993 | Freudelsperger |
| 5,292,029 | A | | 3/1994 | Pearson |
| 5,335,816 | A | | 8/1994 | Kaufman et al. |
| 5,337,919 | A | | 8/1994 | Spaulding et al. |
| 5,348,061 | A | | 9/1994 | Riley et al. |
| 5,377,864 | A | | 1/1995 | Blechl et al. |
| 5,401,059 | A | | 3/1995 | Ferrario |
| 5,431,299 | A | | 7/1995 | Brewer et al. |
| 5,460,294 | A | | 10/1995 | Williams |
| 5,481,855 | A | | 1/1996 | Yuyama |
| 5,528,882 | A | | 6/1996 | Yamamoto |
| 5,533,606 | A | | 7/1996 | Yuyama |
| 5,577,371 | A | * | 11/1996 | Lang et al. ..... 53/589 |
| 5,593,267 | A | | 1/1997 | McDonald et al. |
| 5,597,995 | A | | 1/1997 | Williams et al. |
| 5,604,692 | A | | 2/1997 | Yuyama |
| 5,648,751 | A | | 7/1997 | Yuyama et al. |
| 5,671,592 | A | | 9/1997 | Yuyama et al. |
| 5,678,393 | A | | 10/1997 | Yuyama et al. |
| 5,704,516 | A | | 1/1998 | Yuyama |
| 5,709,063 | A | | 1/1998 | Yuyama et al. |
| 5,713,485 | A | | 2/1998 | Liff et al. |
| 5,713,487 | A | | 2/1998 | Coughlin |
| 5,720,154 | A | | 2/1998 | Lasher et al. |
| RE35,743 | E | | 3/1998 | Pearson |
| 5,722,215 | A | | 3/1998 | Yuyama |
| 5,758,095 | A | | 5/1998 | Albaum et al. |
| 5,761,877 | A | | 6/1998 | Quandt |
| 5,762,235 | A | | 6/1998 | Coughlin |
| 5,765,606 | A | | 6/1998 | Takemasa et al. |
| 5,771,657 | A | | 6/1998 | Lasher et al. |
| 5,787,678 | A | | 8/1998 | Koike et al. |
| 5,798,020 | A | | 8/1998 | Coughlin et al. |
| 5,800,113 | A | | 9/1998 | Yuyama et al. |
| 5,803,309 | A | | 9/1998 | Yuyama et al. |
| 5,810,061 | A | | 9/1998 | Yuyama |
| 5,819,500 | A | | 10/1998 | Haraguchi et al. |
| 5,832,693 | A | | 11/1998 | Yuyama et al. |
| 5,838,245 | A | | 11/1998 | Murakami et al. |
| 5,839,257 | A | | 11/1998 | Soderstrom et al. |
| 5,839,836 | A | | 11/1998 | Yuyama et al. |
| 5,852,911 | A | | 12/1998 | Yuyama et al. |
| 5,852,971 | A | | 12/1998 | Yuyama et al. |
| 5,862,942 | A | | 1/1999 | Yuyama et al. |
| 5,875,610 | A | | 3/1999 | Yuyama et al. |
| 5,946,883 | A | | 9/1999 | Yuyama et al. |

OTHER PUBLICATIONS

Medical Packaging, Inc., "AutoPackTM–A Fully automated Unit Dose Packaging System" undated—Date: Not later than Dec. 3, 1997, probably 1996.

Baker APS, "Expand Your Pharmacy's Potential with the Total Automation Starter Kit from Baker APS", undated. Date: Not later than Dec. 3, 1997, probably 1995.

Innovation Associates, "PharmASSIST", undated. Date: Not later than Dec. 3, 1997, probably Aug. 1997.

Innovation Associates, "PharmASSIST order Entry Manual Filling . . . ", undated.

Tosho, "Tosho Main–Topra Series PC–Cat", undated in the English language. Date: Not later than Dec. 3, 1997, probably 1993.

Baker APS, "Baker The Pharmacy Productivity Company—Pharmacy 1000", undated. Date: Not later than Dec. 3, 1997, probably Jun. 1997.

Sanyo, "AIC–RNC7/RNV7", undated in the English language. Date: Not later than Dec. 3, 1997, probably early 1990s.

* cited by examiner

MEDICATION COLLECTING SYSTEM

RELATED APPLICATION

This patent application is a continuation of U.S. patent application Ser. No. 09/205,861 filed Dec. 4, 1998 now U.S. Pat. No. 6,170,230.

FIELD OF THE INVENTION

The present invention relates to a medication dispensing apparatus which contains a plurality of different kinds of medication (in this application the terms medication and medicament are used interchangeably) separately, dispenses the medicament to pack them into a package belt, and discharges the package belt, as well as a medication collecting system in which a medication dispensing station comprising the medication dispensing apparatus is disposed along a conveyor line and by which medication discharged from the medication dispensing station is placed onto a tray conveyed along the conveyor line and then collected.

BACKGROUND OF THE INVENTION

It is an idea disseminated in the 1960s in Japan that medication may be packaged in dosages and delivered to patients. This idea has been put into practical use mainly as packaging machines for powdered medicines. Tablet machines were developed in 1970s, and ampoule dispensing machines were developed in 1990s. These machines have been used in different ways according to their respective proper applications.

U.S. Pat. No. 5,604,692 discloses an apparatus in which a plurality of preparation stations classified according to the type of medication are arranged along a conveyor line and in which medicaments prepared at the individual preparation stations are collected to a checking station by the conveyor line. This apparatus prepares medicaments for the time period described in the prescription and delivers the medicaments to the patient.

In recent years, there has been developed an idea that medicaments prescribed to one patient are all collected regardless of the type of medicament and provided to the patient. This idea has been put into U.S. patent application Ser. No. 09/021,864, the assignee of which is the same as one of the assignees of the present application.

In America, medicaments for one-day doses to be administered to inpatients are placed in a packaged box in the dispensary, and the box is stored in a movable medication storage cabinet, for example, MEDSTATION marketed by Pyxis Co. With the medication storage cabinet provided in the nurse station, when the medicament administration time comes, medicaments are taken out from the medication storage cabinet and administered to patients. Upon completion of the medicament administration for one-day doses, the medication storage cabinet is returned to the dispensary. The medication storage cabinet in which medicaments for the next day have been stored is then moved to the nurse station. By adopting such a system, clear histories of the administration to the patients can be obtained, allowing accounting, medicament inventory management and the like to be carried out collectively.

However, medicaments, particularly tablets, for one-day doses are packaged in the form of a continuous package belt. The package belt comprises a medication package portion in which one dose of tablet is packed, a print portion in which patient information, medicament information, dosage information and the like are printed, and an empty package portion which is inserted between different patients. This package belt arrangement necessitates troublesome work such as separating off medication packages for each patient or for each dose, or cutting off empty packages. In particular, in the case of, for example, medicaments to be ordered in operation rooms, CPUs, or emergency departments, it is desired that such work as the separation of medication packages and the cutoff of empty packages be achieved promptly for subsequent delivery of the medicaments.

SUMMARY OF THE INVENTION

The present invention having been accomplished in view of these and other problems, an object of the invention is to provide a medication collecting system which is capable of automatically and promptly achieving the separation of medication packages in the medication package belt and the cutoff of empty packages.

In order to achieve the above object, the present invention provides a medication dispensing apparatus which contains a plurality of different kinds of medication separately, dispenses the medicament to pack them into package belt, and discharges the package belt, comprising:

cutting means for cutting the package belt into shortened package belts including at least one medication package for a specified period in accordance with prescription data;

stacking means for stacking the short package belts; and bundling means for bundling the stacked short package belts.

The present invention also provides a medication collecting system, comprising:

a tray feed station for accumulating a plurality of empty trays and feeding the trays to a conveyor line;

a medication dispensing station for containing a plurality of different kinds of medication separately, dispensing the medicament to pack them into package belt, and discharging the package belt into the tray fed to the conveyor line from the tray feed station; and a tray recovering station for recovering the tray containing the package belt discharged from the medication dispensing station and for sorting the trays;

wherein the medication dispensing station comprises;

cutting means for cutting the package belt into shortened package belts including at least one medication package for a specified period in accordance with prescription data;

stacking means for stacking the short package belts; and bundling means for bundling the stacked short package belts.

With the medication dispensing apparatus and the medication collecting system having the above constitutions, the separation of medication packages in the medication package belt and the cutoff of empty packages can be achieved automatically and promptly so that medication delivery work in the hospital-can be reduced.

Preferably, the cutting means cuts the package belt into short package belts including medication packages taken at a day or at a time. Also, preferably, the short package belt cut by the cutting means includes at least one printed empty package and at least one medication package. Further, preferably, the cutting means cuts the empty package included in the package belt and the stacking means stacks the short package belts excluding the empty package.

Preferably, the medication dispensing station further includes: separating means for separating empty packages from the bundled short package belts; and means for putting the bundled short package separated by the separating means into the tray fed to the conveyor line.

The medication collecting system may further comprise a liquid medication dispensing station for containing a plurality of different kinds of liquid medication or ampoules separately, dispensing the liquid medicament, and discharging the liquid medicament into the tray fed to the conveyor line from the tray feed station.

BRIEF DESCRIPTION OF THE DRAWINGS

The following description of an embodiment of the present invention is carried out with reference to the accompanying drawings, in which.

DETAILED DESCRIPTION OF THE PREFERRED EMBODIMENT

Figure 1:
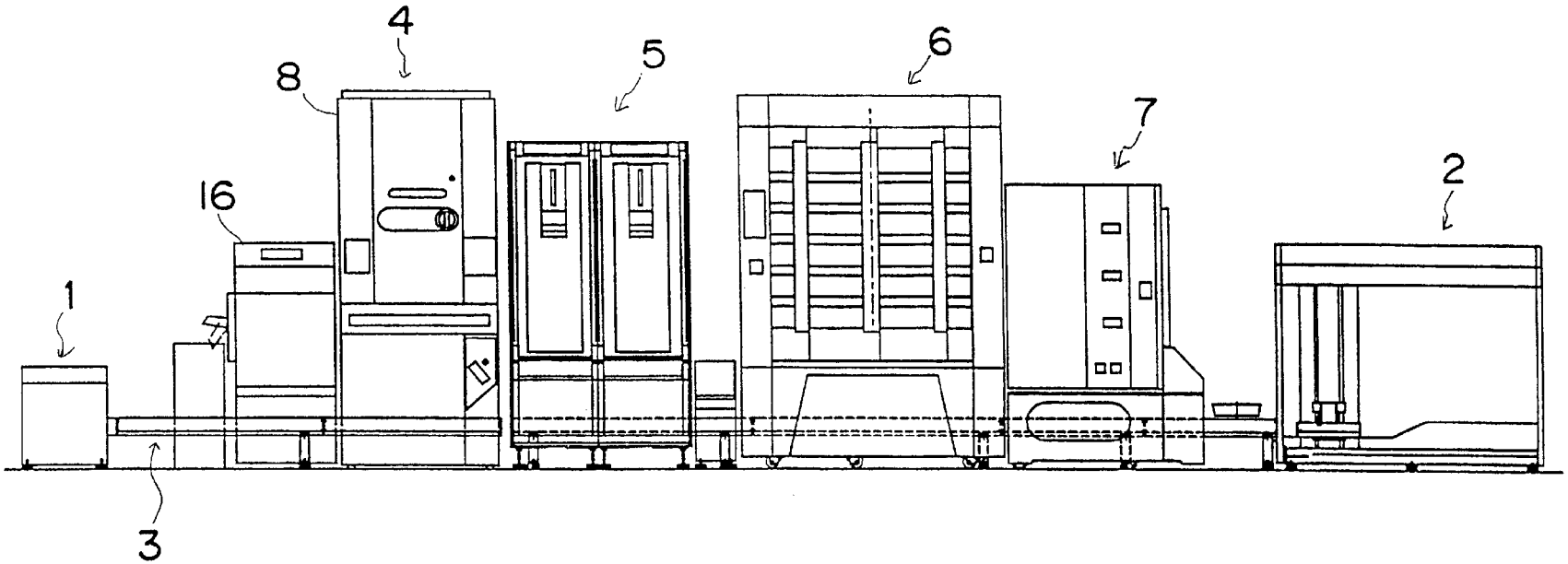
FIG. 1 is a schematic view of a medication collecting system according to the embodiment of the invention.

FIG. 1 shows a medication collecting system according to the present embodiment.

In this medication collecting system, a tablet dispensing station 4, an array ampoule dispensing station 5, a random ampoule dispensing station 6 and a label issuing station 7 are disposed one after another along a conveyor line 3 that connects a tray feed station 1 and a tray recovering station 2 to each other.

<Tray Feed Station>

Figure 2A:
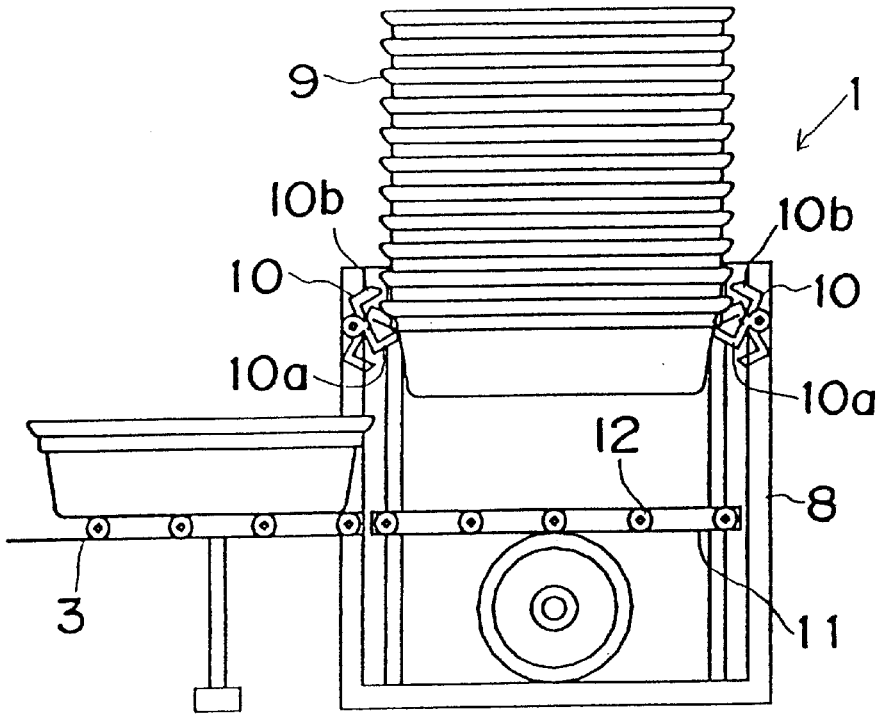
FIG. 2A is a front view of an initial state showing the tray discharging structure of the tray feed station.
Figure 2B:
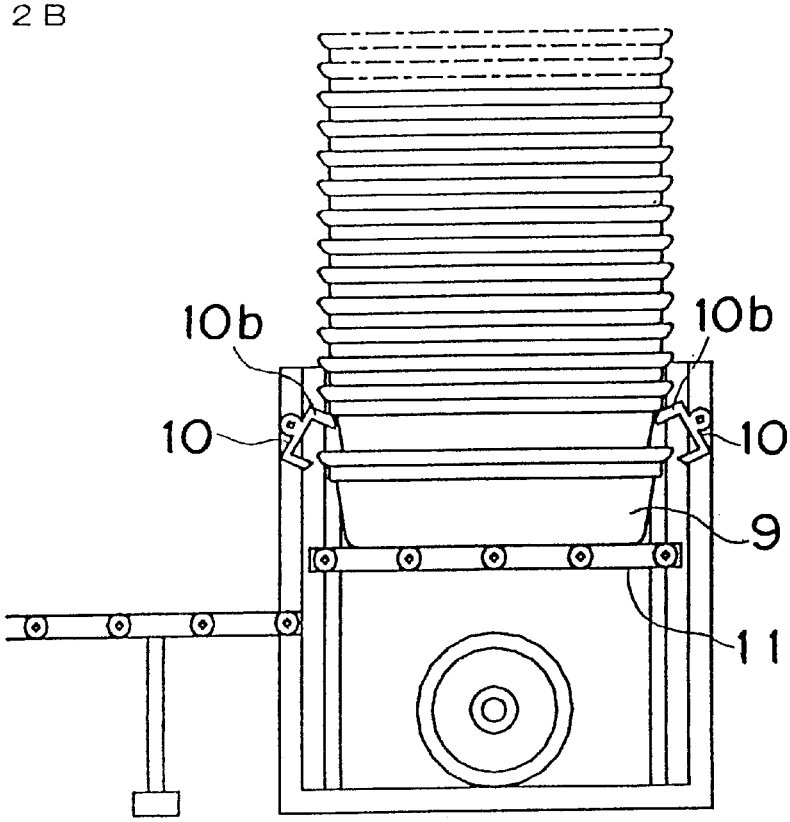
FIG. 2B is a front view showing a state in which the lowermost tray is discharged.

The tray feed station 1, in which a plurality of trays 9 are stored in a stacked state within a cylindrical housing 8 having a rectangular cross section as shown in FIG. 2A, is enabled to feed out the trays 9 one by one. The housing 8 has, on its opposite sides, support feed claws 10 which are pivoted by an unshown motor or the like, respectively. The support feed claws 10 support peripheries of the lowermost tray 9 by their lower claw portions 10*a* and, by pivoting, place the lowermost tray 9 onto a feed-out plate 11 located below the lowermost tray 9. During this process, the support feed claws 10 support peripheries of the next tray 9 by their upper claw portions 10*b* as shown in FIG. 2B, thereby making it possible to take out only the lowermost tray 9. In addition, the support feed claws 10, after taking out the lowermost tray 9, return to the original position and support the next tray 9 by their lower claw portions 10*a*. The feed-out plate 11, which is guided by a lower opposite face of the housing 8, can be moved up and down by a motor or the like. This feed-out plate 11 has a plurality of rotation-drivable rollers 12 provided in parallel. In the lower operating position, the feed-out plate 11 is enabled to transversely convey the tray 9 placed through a lower opening of the housing 8 and feed out the tray 9 to the conveyor line 3.

<Tablet Dispensing Station>

Figure 3:
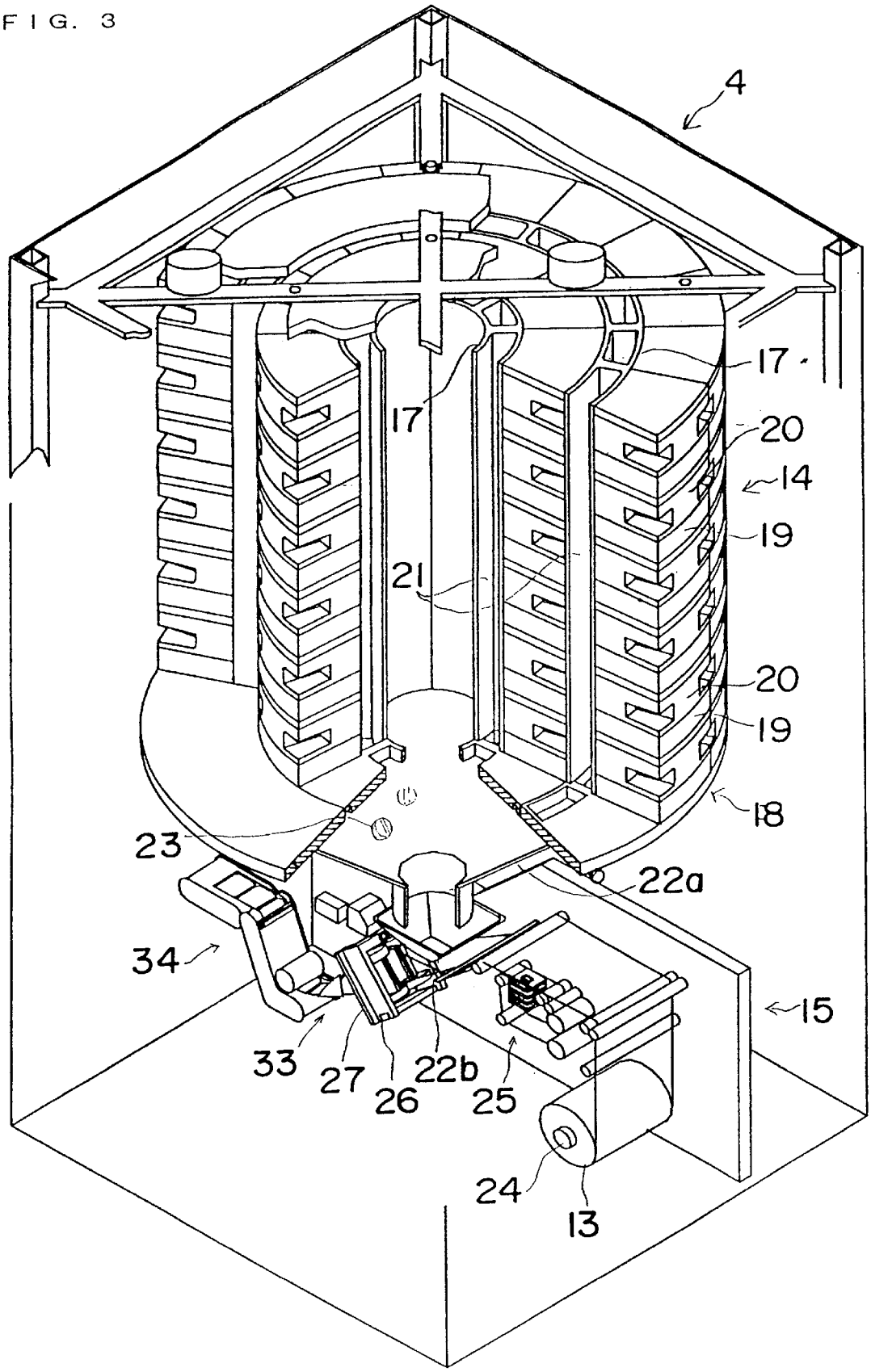
FIG. 3 is a partly broken perspective view showing the tablet dispensing station of FIG. 1.

The tablet dispensing station 4, which is provided to pack tablets 23 into a strip-shaped package belt 13 in doses, comprises a tablet feed section 14, a printing and packaging section 15 and a package-belt bundling section 16 (FIG. 1) as shown in FIG. 3.

The tablet feed section 14 comprises a cylindrical drum 18 equipped with tablet guide parts 17 being doubled inside and outside and extending up and down, a plurality of motor bases 19 disposed vertically and circumferentially on outer periphery of each tablet guide part 17, and a plurality of tablet cassettes 20 removably attached to the motor bases, respectively. Each tablet guide part 17 is divided circumferentially for each column of the vertically arrayed motor bases 19 and tablet cassettes 20, by which a tablet guide passage 21 extending vertically is formed. Below the cylindrical drum 18, are disposed hoppers 22*a*, 22*b*, which make it possible to collect tablets 23 dropping via the tablet guide passages 21 to one place.

In the tablet cassettes 20, different types of tablets 23 are stored, respectively, and tablets 23 amounting to one-day doses are discharged in units of one dose based on prescription information. The discharged tablets 23 are counted by sensors (not shown) provided on the motor bases 19, and fed to the printing and packaging section 15 via the hoppers 22 through the tablet guide passages 21. The number of tablets left in a tablet cassette 20 can be counted based on the number of initial storage number and the count number by the sensor, allowing a decision as to whether or not the tablets are lacking.

The printing and packaging section 15 comprises a roll 24 on which the package belt is wound, a printing part 25 for printing specified information on the surface of the package belt 13, a sealing part 26 for sealing the package belt 13 in doses, and a cutter part 27 for cutting the package belt 13 into specified lengths.

Figure 4:
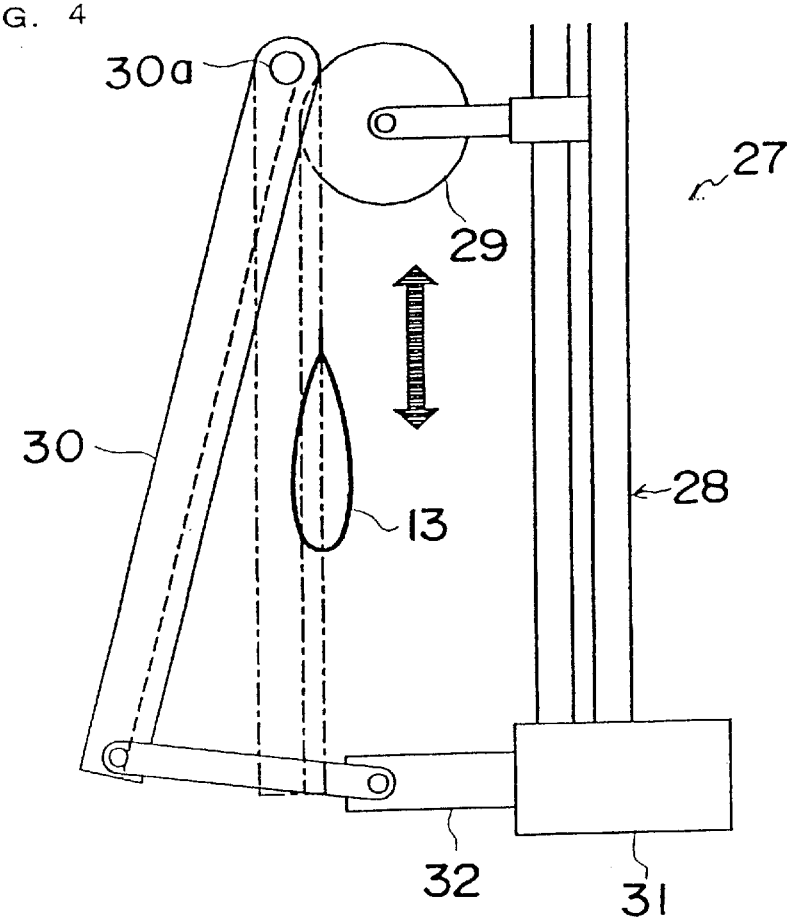
FIG. 4 is a front view showing the cutter part of FIG. 3.

The cutter part 27, as shown in FIG. 4, comprises a circular cutter 29 provided so as to be movable up and down along a guide shaft 28, and a pivotable cutter guide 30 which has a guide recess for guiding the peripheral cutting edge of the cutter 29 and which is pivotable about a pivot 30*a* provided at an upper end. A rod 32 of a solenoid 31 is coupled to a lower end portion of the cutter guide 30 so that the cutter guide 30 can be put into adjacency to the package belt 13, facilitating the cutting by the cutter 29.

The package-belt bundling section 16 is provided to bundle and bind the package belt 13 cut by the cutter 29. To this package-belt bundling section 16, the package belt 13 is fed via a direction changing part 33 and a conveyor 34.

Figure 5:
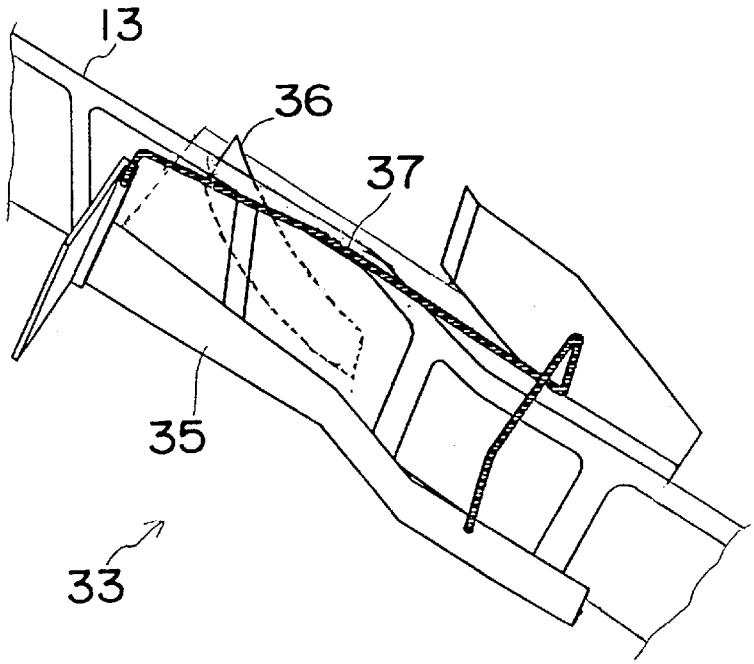
FIG. 5 is a perspective view showing the direction changing part of FIG. 3.

The direction changing part 33, as shown in FIG. 5, is provided to turn the cut package belt 13 approximately 90 degrees (from generally vertical to generally horizontal) while conveying the package belt 13 in the direction of arrow. This direction changing part 33 comprises a guide member 35 for guiding the package belt 13, a guide plate 36 for guiding the lower edge of the package belt 13 to the guide member 35, and a wire 37 for gradually engaging the upper edge of the package belt 13 to turn the package belt 13 sideways.

Figure 6:
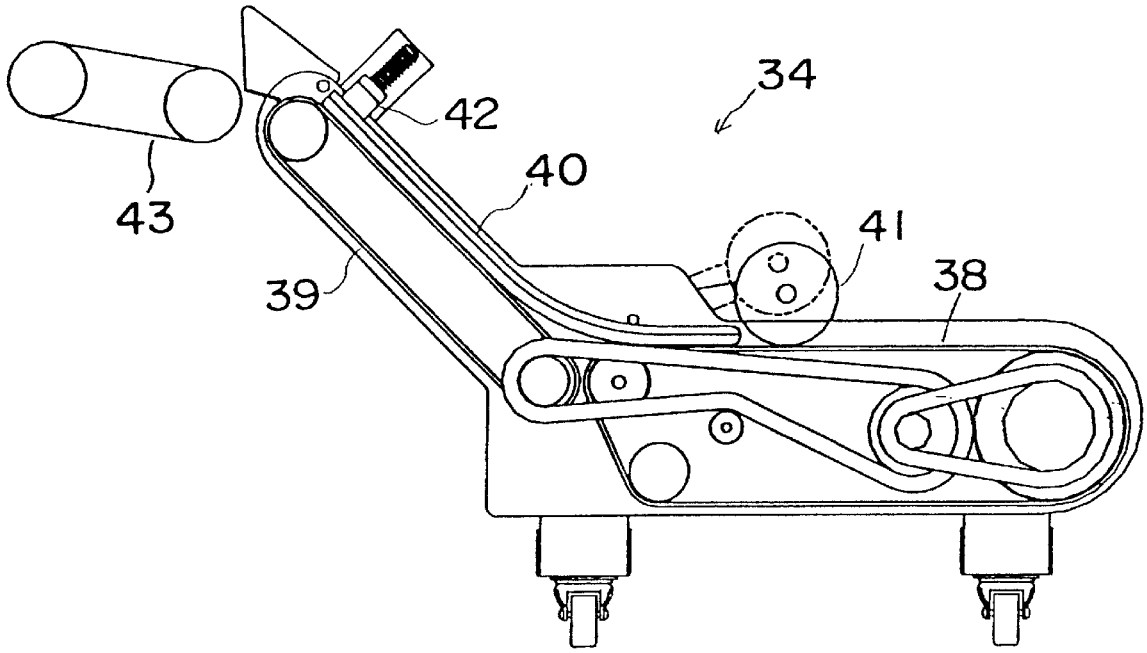
FIG. 6 is a front sectional view showing the conveyor of FIG. 3.

The conveyor 34, as shown in FIG. 6, is enabled to convey the package belt 13 obliquely upward by a horizontal conveyor belt 38 and a sloped conveyor belt 39. A tension sheet 40 is disposed above part of the horizontal conveyor belt 38 and the sloped conveyor belt 39. This tension sheet 40 is formed of a flexible material having small frictional resistance. A sponge roller 41 is disposed up-and-down swingably on the entrance side of an insertion passage defined by the belt 38 and the tension sheet 40. The belt 38 being set to a conveyance speed higher than that in the direction changing part 33. If an unreasonable tensile force should act upon the swinging movement of the package belt 13, an unshown limit switch is turned off by the sponge roller 41 so that the driving of the belt 38 is stopped. Meanwhile, on the exit side of the insertion passage, a presser member 42 biased by a spring is provided, biasing the tension sheet 40 toward the belt 39. As a result, the package belt 13 is pressed against the belt 38 with the frictional resistance increased, so that the package belt 13 can be prevented from clogging on the exit side. In addition, reference numeral 43 denotes a delivery belt for delivering the package belt 13 to the package-belt bundling section 16.

Figure 7:
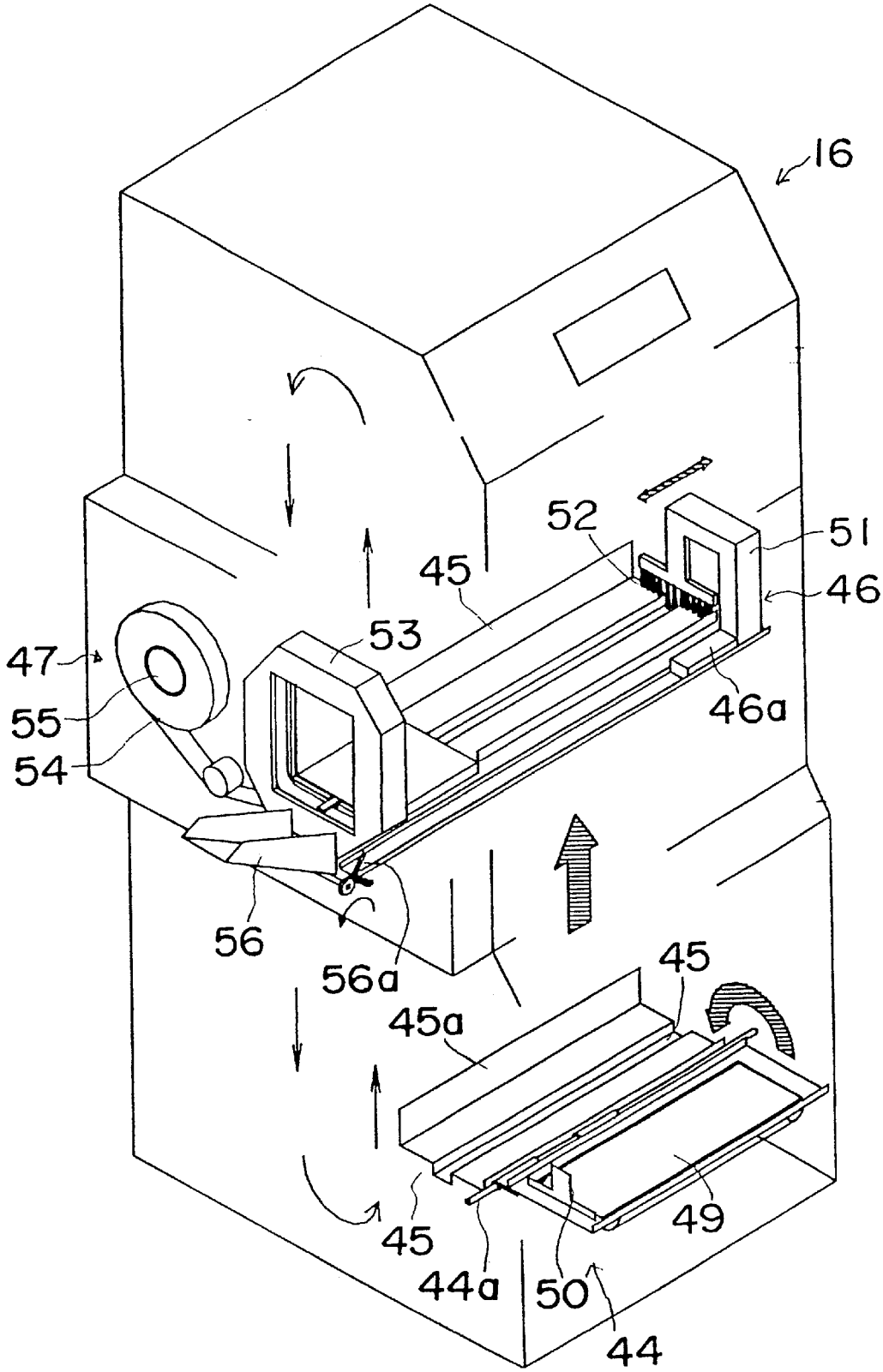
FIG. 7 is a perspective view showing the package-belt bundling section of FIG. 1.
Figure 8:
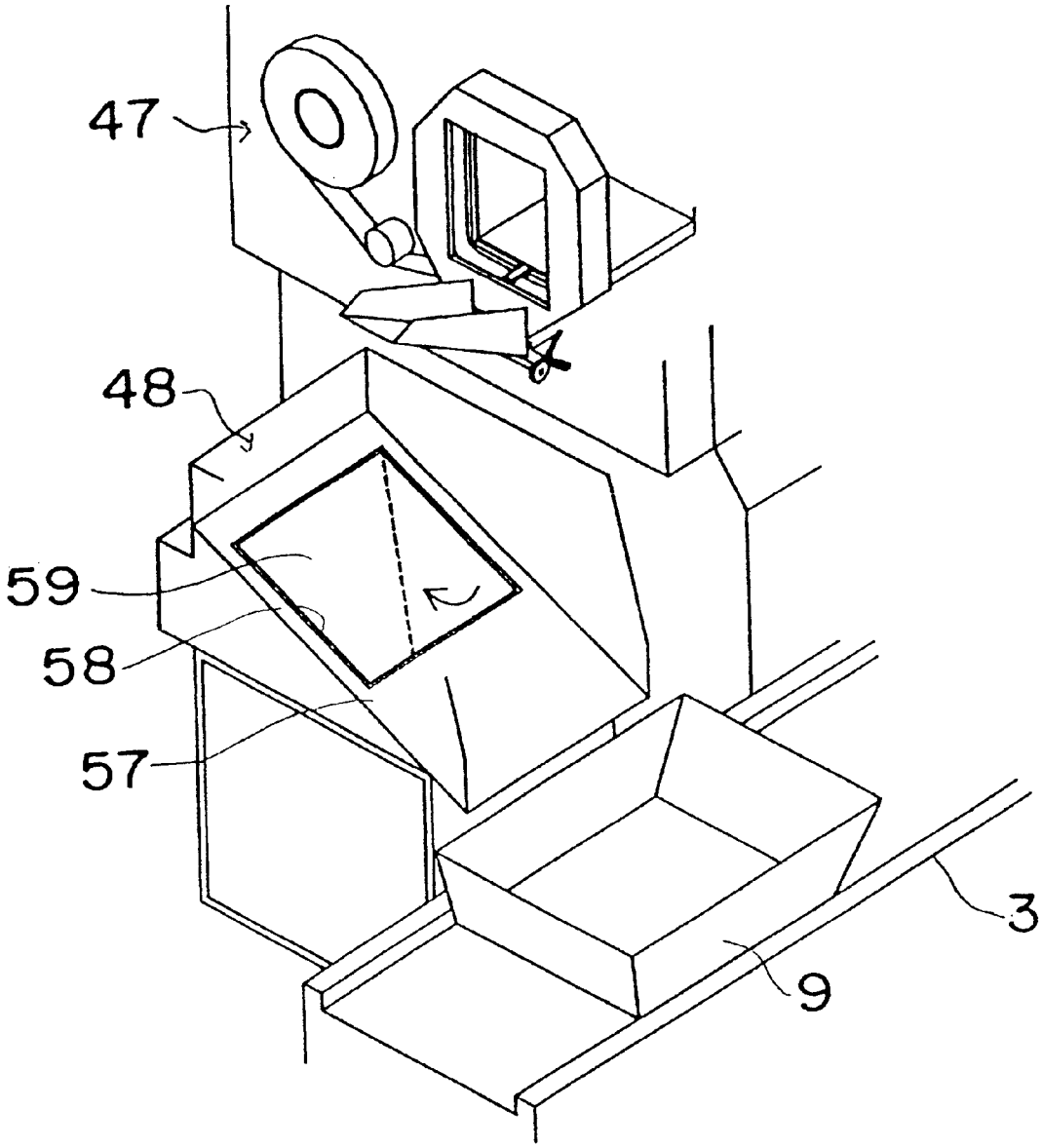
FIG. 8 is a perspective view showing the distributing member of FIG. 7.

The package-belt bundling section 16, as shown in FIGS. 7 and 8, comprises an inverting member 44, a lifter 45, a feed-in member 46, a bundling machine 47 and a distributing member 48.

The inverting member 44 is supported so as to be reciprocatively pivotable over a range of approximately 180 degrees about a support shaft 44*a*. This inverting member 44 comprises a pull-in conveyor 49 for pulling in the package belt 13 from the delivery belt 43. A stopper 50 for positioning the conveyed-in package belt 13 is protrusively provided at an end portion of the pull-in conveyor 49. A sensor (not shown) is provided in proximity to the stopper 50 so that the presence or absence of the package belt 13 can be detected.

The lifter 45 is plate-shaped and has a side wall 45*a* extending along both side edge portions, and a recess 45*b* extending longitudinally in a central portion. The lifter 45 is reciprocatively moved between a lower position where the package belt 13 inverted by the inverting member 44 can be loaded, and an upper position where the package belt 13 can be conveyed to the bundling machine 47 by the feed-in member 46.

The feed-in member 46 has a brush 52 provided at an end of a feed-in arm 51 that reciprocatively moves along the side portion 45*a* of the lifter 45 located in the upper position.

The bundling machine 47 comprises a looped rectangular frame body 53, and a roller 55 on which bundling tape 54 is wound, where central part of the stacked package belt 13 can be bundled with the tape 54 unwound from the roller 55. A chute 56 is provided in proximity to the bundling machine 47. This chute 56 has a tip end directed obliquely upward, and a presser 46*a* of the feed-in member 46 presses a lever 56*a*, by which the chute 56 is pivoted and directed obliquely downward.

Figure 9:
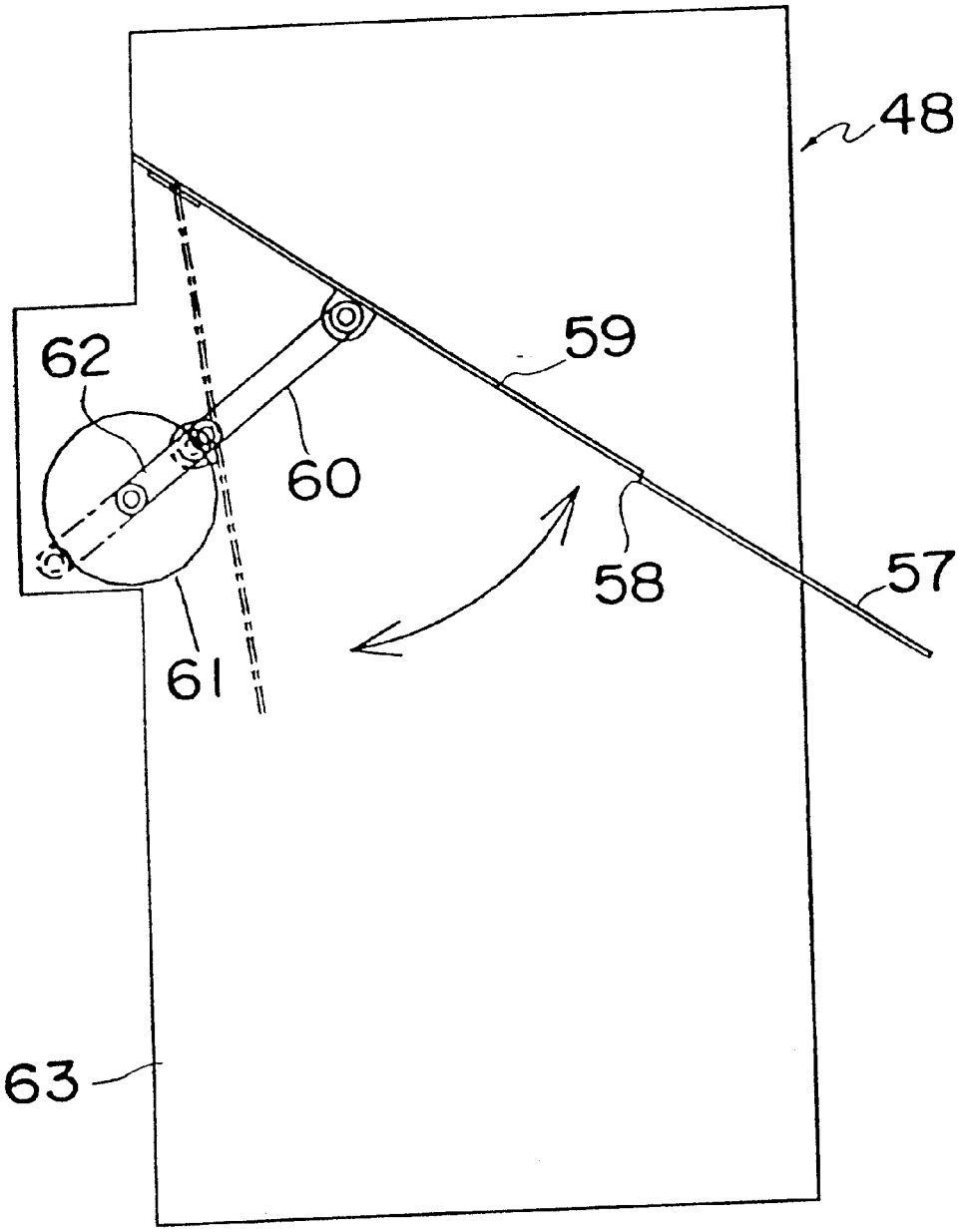
FIG. 9 is a side sectional view of FIG. 8.

The distributing member 48, as shown in FIG. 8, has an opening 58 formed in a sloped plate 57 directed obliquely downward, and this opening 58 is opened and closed by a distributing plate 59. A lower end edge of the sloped plate 57 extends to the conveyor line 3, allowing the bundled package belt 13 to be accommodated in the tray 9. Also, a first link 60 is pivotably coupled at its one end portion to the distributing plate 59 as shown in FIG. 9. A second link 62 provided on the rotating shaft of a motor 61 is pivotably coupled to the other end portion of the first link 60. The motor 61 is so designed as to stop every 180 degree rotation. As a result of this, the distributing plate 59 is pivotable between one position where the distributing plate 59 is aligned with the sloped plate 57 with the lower edge slightly out of alignment with the top surface, and another position where the distributing plate 59 is positioned generally vertical. Also, a dust box 63 is disposed below the opening 58 of the sloped plate 57, so as to collect unnecessary portions (empty packages) of the package belt 13.

<Array Ampoule Dispensing Station>

Figure 10:
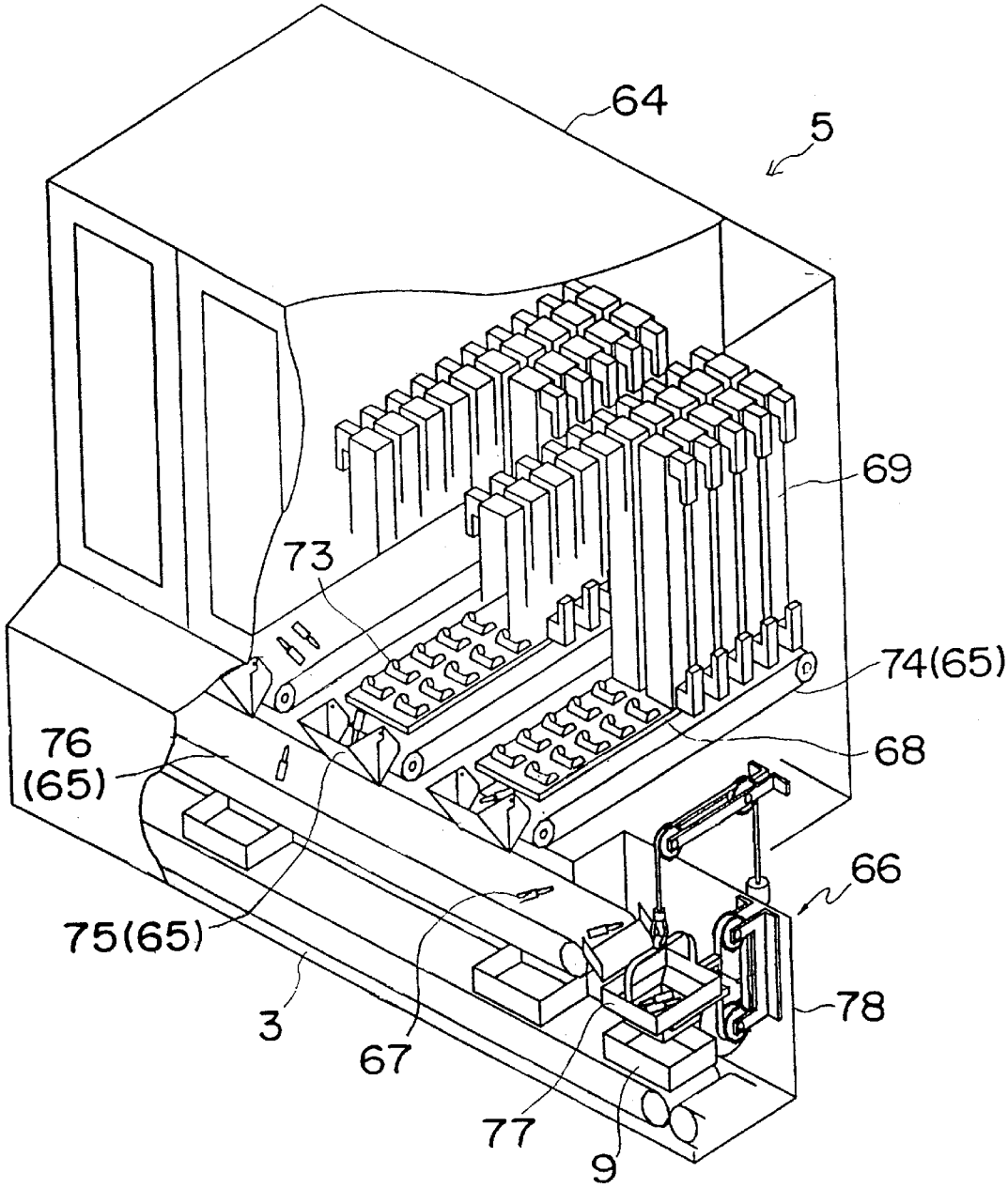
FIG. 10 is a partly broken perspective view showing the array ampoule dispensing station of FIG. 1.

The array ampoule dispensing station 5, as shown in FIG. 10, comprises an ampoule storage section 64, an ampoule conveying section 65 and an ampoule dispensing section 66, and is used mainly to dispense ampoules 67 each having a large capacity as much as 10 to 30 ml (for more details, see Japanese Patent Laid-Open Publication HEI 7-267370).

Figure 11A:
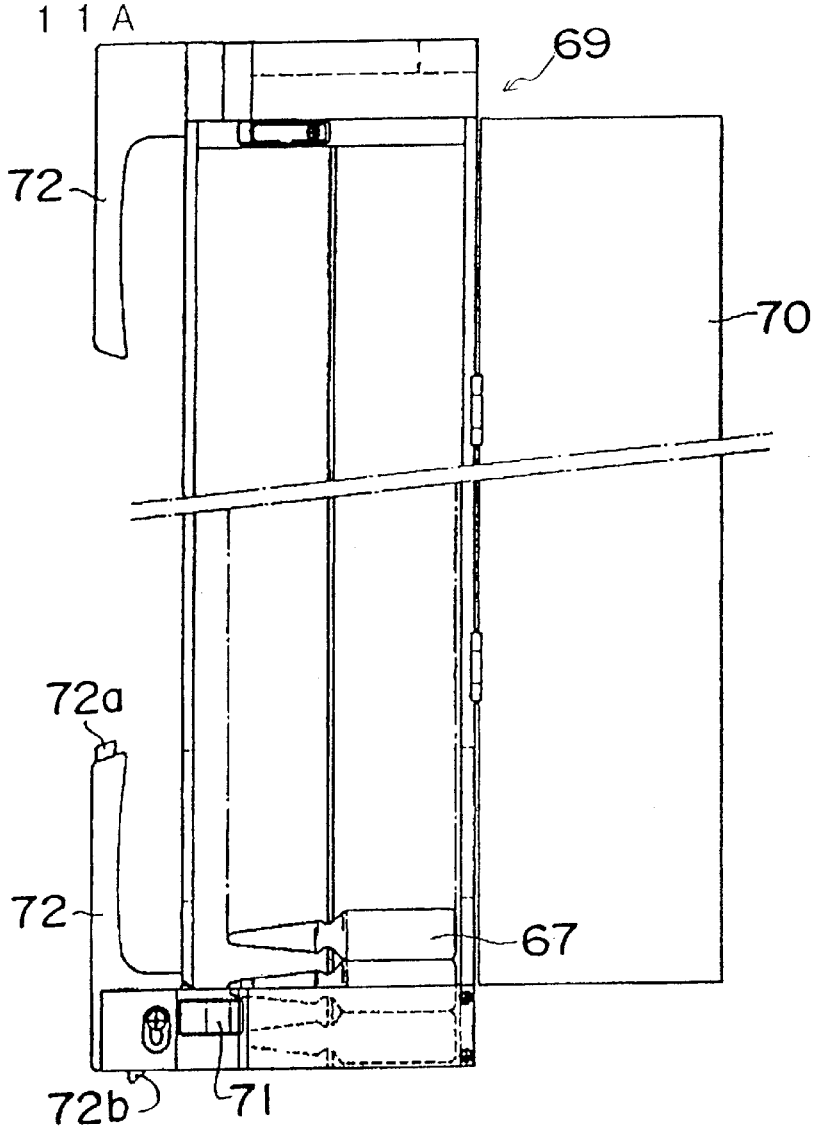
FIG. 11A is a front sectional view showing the ampoule cassette of FIG. 10.
Figure 11B:
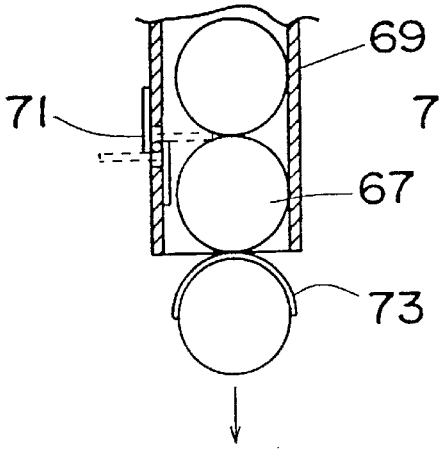
FIG. 11B is a partial sectional view showing an ampoule discharging state including a stop provided in a lowermost portion of the ampoule cassette.
Figure 11C:
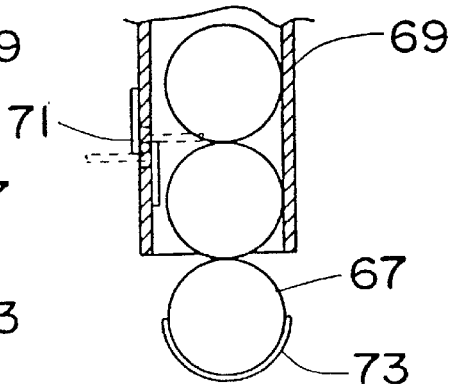
FIG. 11C is a partial sectional view showing an ampoule-holding state including the stop.

In the ampoule storage section 64, a plurality of drawer cradles 68 are provided in array. In each drawer cradle 68, a plurality of ampoule cassettes 69 are provided in array. Each ampoule cassette 69, as shown in FIG. 11A, is shaped into a box having an openable/closable door 70 provided on one side face, and in its interior, the ampoules 67 are stored in a laterally-postured and arrayed state. Also, as shown in FIGS. 11B and 11C, the lower face of the ampoule cassette 69 is opened, where a stop 71 is provided at the opening so as to prevent the ampoules 67 from falling off. When the ampoule cassette 69 is set up, only the lowermost-positioned ampoule 67 can be discharged out downward by withdrawing of stop 71. Further, handles 72 each protruding in a generally L shape are formed above and below on one side face of the ampoule cassette 69 perpendicular to the door 70. Detent actuator portion 72*a* is formed in the lower handle 72, so that an engaging detent 72*b* provided at the lower end surface of the ampoule cassette 69 can be operated to extend and retract. By this engaging detent, the ampoule cassette 69 can be attached to the drawer cradle 68. The drawer cradle 68 is equipped with discharge rotors 73, and the ampoules 67 within the ampoule cassette 69 can be discharged one by one by the discharge rotor 73 pivoting between the states of FIGS. 11B and 11C. In addition, an insertion hole (not shown) intended for a sensor is bored in the lower-end side surface of the ampoule cassette 69, making it possible to detect that the remaining quantity of stock of the ampoules 67 has decreased or is lacking.

The ampoule conveying section 65 comprises a first conveyor belt 74 disposed below the drawer cradle 68, a stock storage 75 provided at the conveyance end of the first conveyor belt 74, and a second conveyor belt 76 disposed below the stock storage 75 generally perpendicular to the first conveyor belt 74.

The ampoule dispensing section 66 comprises a stock container 77 for storing conveyed ampoules 67, and an up-down member 78 for discharging the ampoules 67 stored in container 67 to the tray 9 on the conveyor line 3 while suppressing any impact force acting on the ampoules 67.

Random Ampoule Dispensing Station

Figure 12:
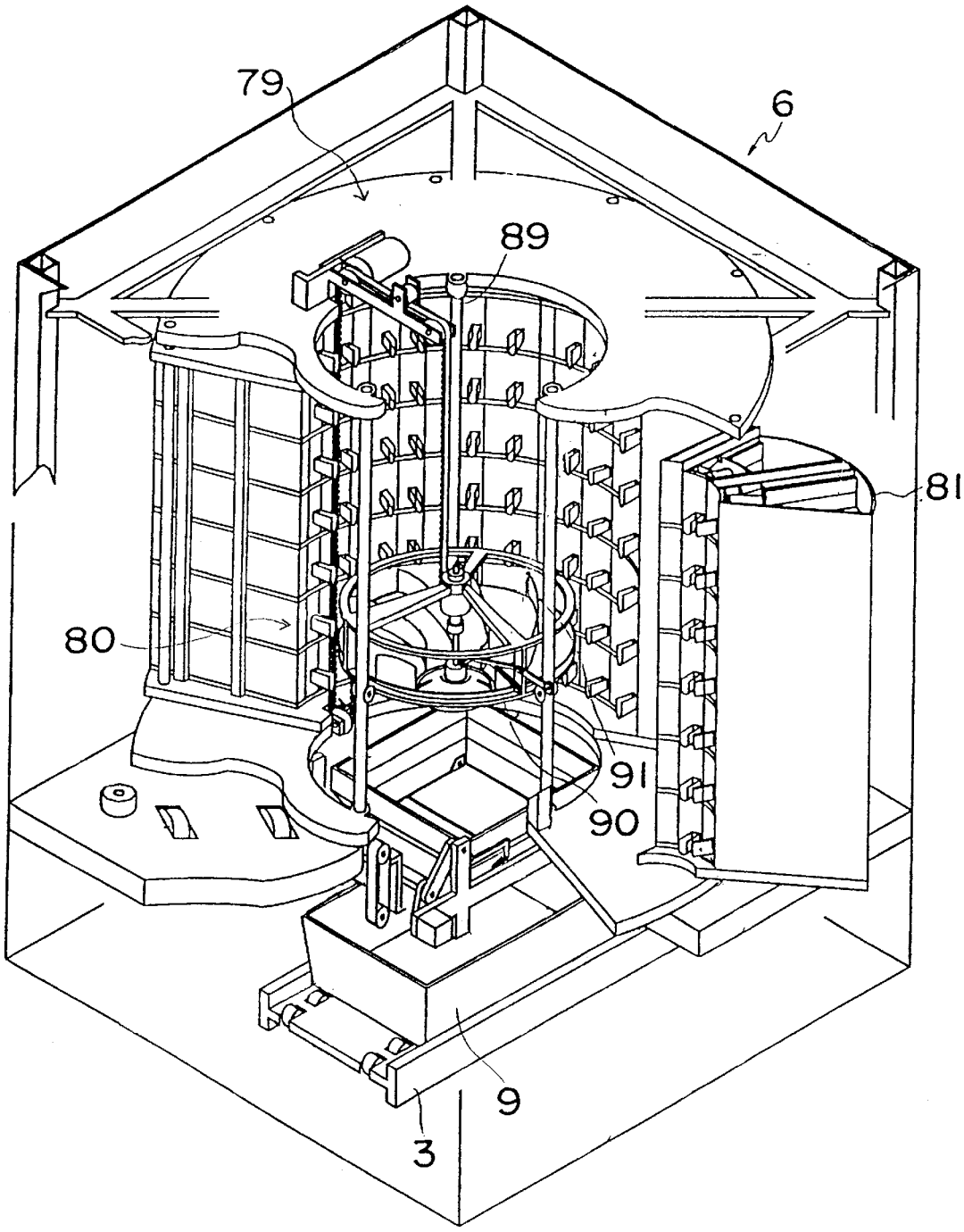
FIG. 12 is a partly broken perspective view showing the random ampoule dispensing station.

The random ampoule dispensing station 6, as shown in FIG. 12, comprises a drum-shaped rotary storage rack 79, and a lifter part 80 which goes up and down in the center of the rotary storage rack 79, and is used to dispense mainly small-capacity ampoules 81 (FIG. 13) with a capacity less than 10 ml (for more details, see Japanese Patent Applications HEI 10-149489, HEI 10-99001, HEI 9-142473, HEI 9-212102, etc.).

Figure 13A:
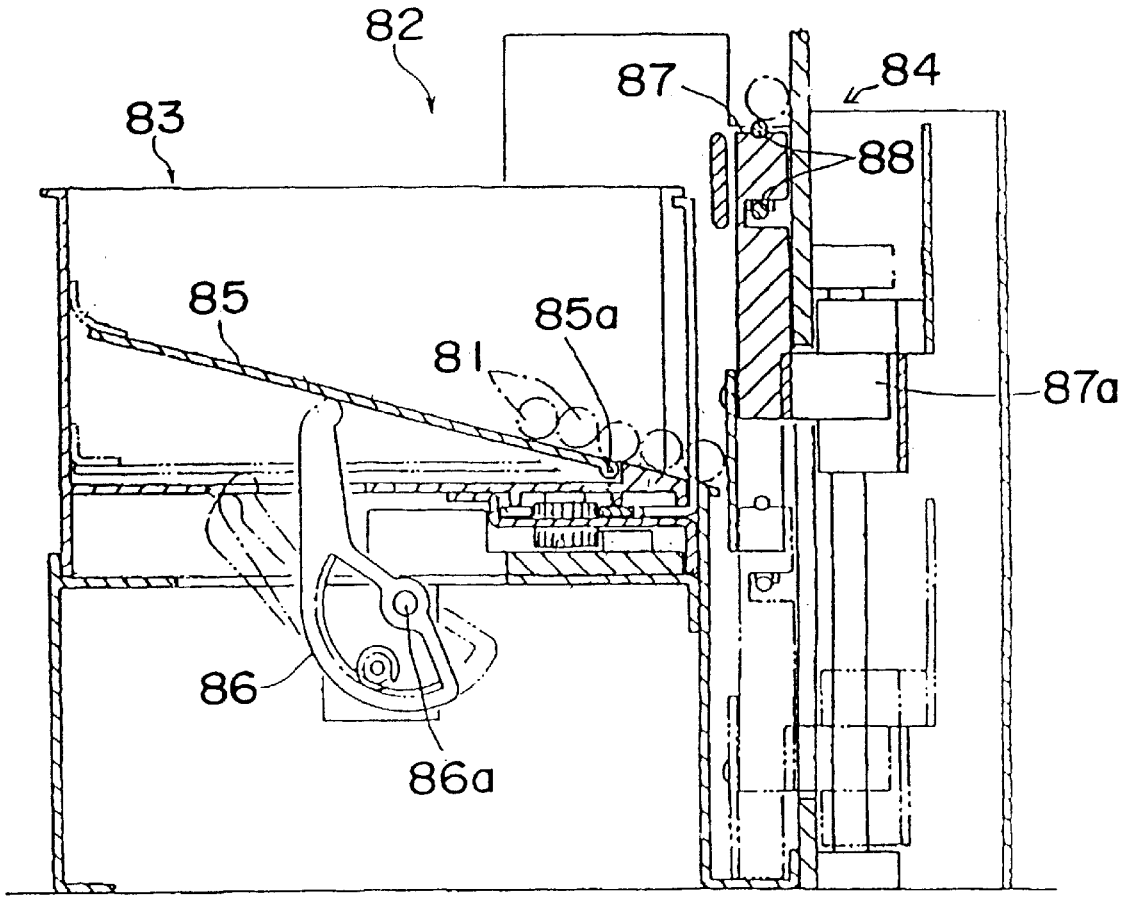
FIG. 13A is a front sectional view showing the ampoule container of FIG. 12.
Figure 13B:
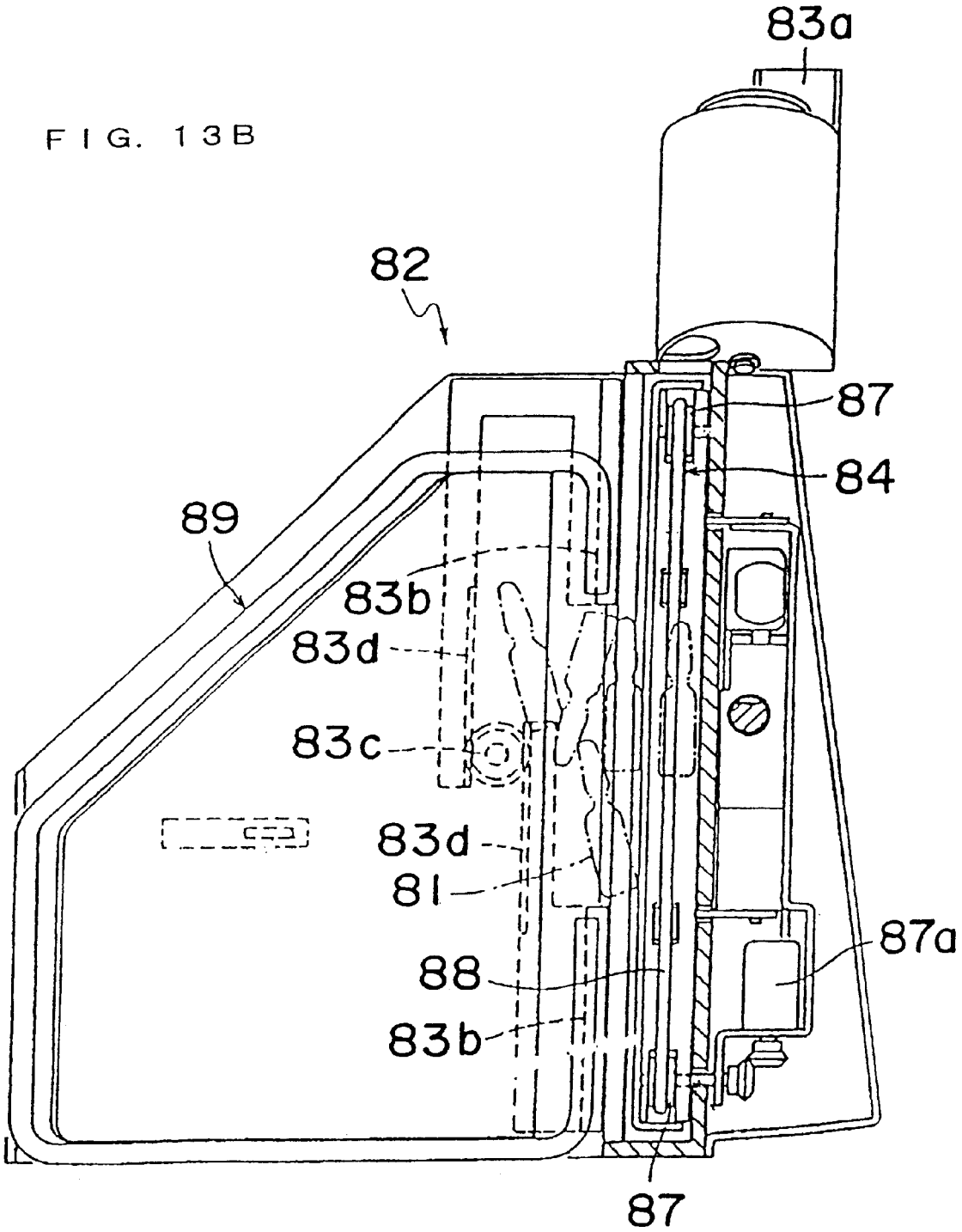
FIG. 13B is a top sectional view showing the ampoule container of FIG. 12.

In the rotary storage rack 79, a plurality of ampoule containers 82 are disposed vertically and circumferentially in so that an up-and-down space for the lifter part 80 can be obtained on the central side. Each ampoule container 82, as shown in FIGS. 13A and 13B, comprises an ampoule storage chamber 83 and an ampoule array-and-conveyance section 84.

A bottom wall 85 of the ampoule storage chamber 83 is pivotable about a pivot 85*a*, and will be inclined by rotation of a rotating arm 86 so that the ampoules 81 can be moved to the ampoule array-and-conveyance section 84. Also, in the ampoule array-and-conveyance section 84, a belt 88 is stretched between pulleys 87 so that the ampoules 81 placed on the belt 88 can be conveyed by one pulley 87 being rotated by the drive of a motor 87*a*. The ampoule array-and-conveyance section 84 can be moved up and down by the drive of a motor, between a lower position where the ampoules 81 within the ampoule storage chamber 83 can be loaded on, and an upper position where the ampoules 81 can be discharged to the lifter part 80 via a chute 83*a*. In addition, the ampoule storage chamber 83 and the ampoule array-and-conveyance section 84 are partitioned from each other by a shutter 83*b* which is and opened and closed with a pinion 83*c* and a rack 83*d*.

Figure 14:
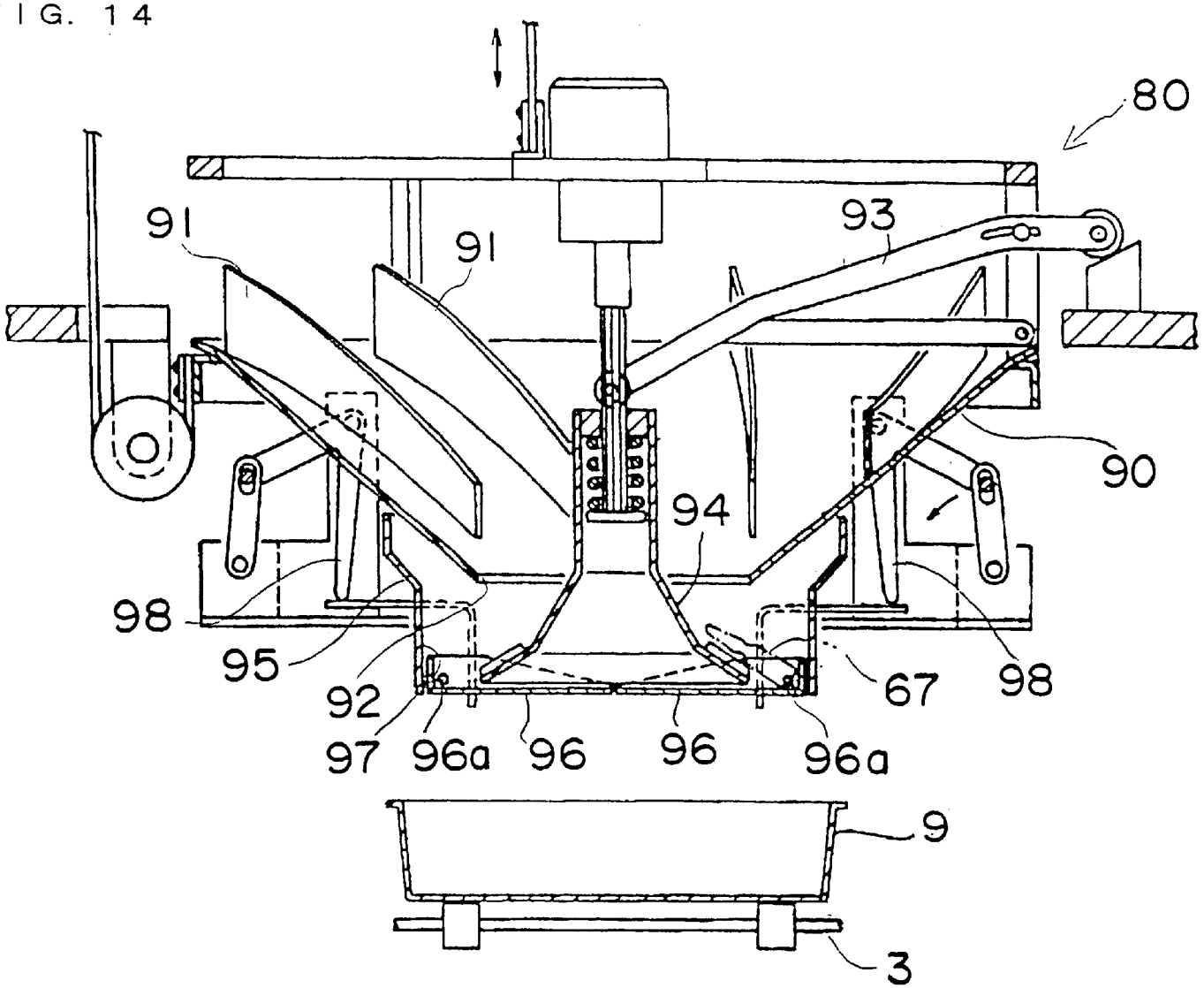
FIG. 14 is a sectional view showing the lifter part of FIG. 12.

In the lifter part 80, as shown in FIGS. 12 and 14, a lifter container 90 is moved up and down along three rails 89 provided vertically in a center-side space of the rotary storage rack 79 (for more details, see Japanese Patent Application HEI 9-71530) The lifter container 90 is funnel-shaped and has spiral guide blades 91 formed therein. The lifter container 90 is rotated by an unshown motor and leads a fed ampoule 67 to a central opening 92 under the guide of the guide blades 91. The opening 92 is opened and closed by an opening/closing valve 94 that is moved up and down with an opening/closing arm 93.

Figure 15A:
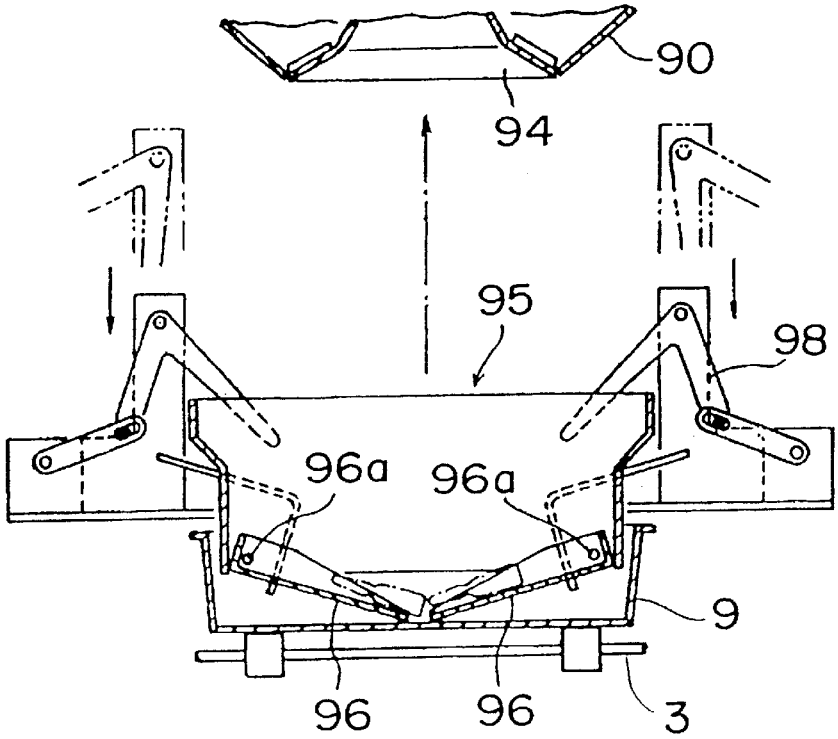
FIG. 15A is a sectional view showing the lifter container of the lifter part of FIG. 14 with its bottom plates released from the closed state.
Figure 15B:
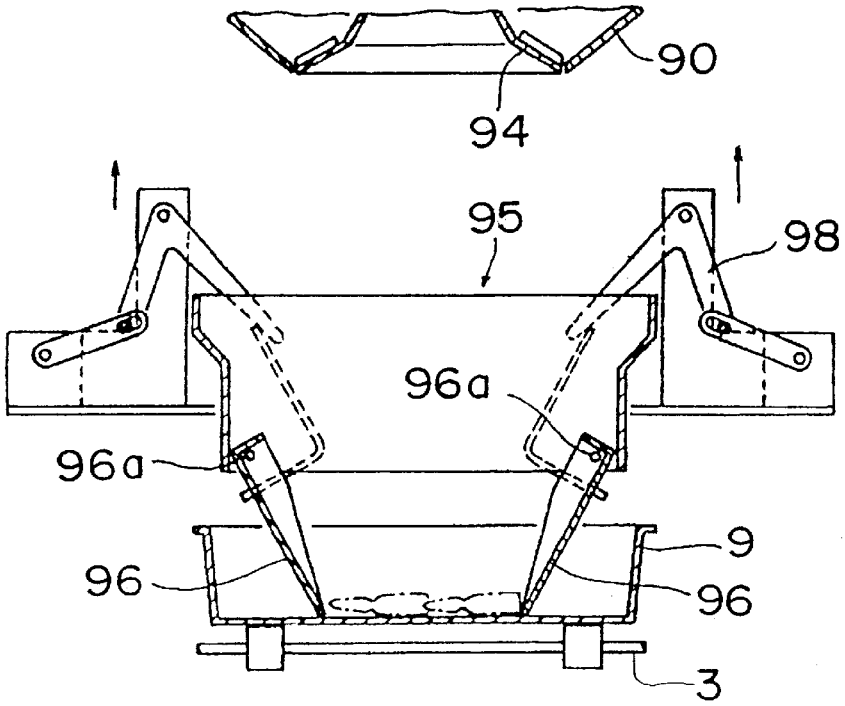
FIG. 15B is a sectional view showing a state in which the lifter container has been elevated from the position shown in FIG. 15A.

Below the lifter container 90, is provided a delivery stock storage device 95. In this delivery stock storage device 95, as shown in FIG. 15A, bottom plates 96 are provided into two divisions, right and left, each of which is pivotable about a pivot 96*a* to open a bottom-face opening 97. The bottom plates 96, as shown in FIG. 14, receive the ampoules 67 from the lifter container 90, and keep the bottom-face opening 97 closed by links 98 until the bottom plates 96 are located above and near the tray 9. Then, when the bottom plates 96 are located above and near the tray 9, the bottom plates 96 are released from the closed state by the links 98, as shown in FIG. 15A. As a result, when the lifter container 90 is moved up relative to the tray 9, the bottom plates 96 pivot while keeping their free end portions in contact with the top face of the tray 9, gradually opening the bottom-face opening 97 as shown in FIG. 15B. Accordingly, the ampoules 67 discharged from the lifter container 90 are smoothly moved into the tray 9 without undergoing any impact force.

<Label Issuing Station>

Figure 16:
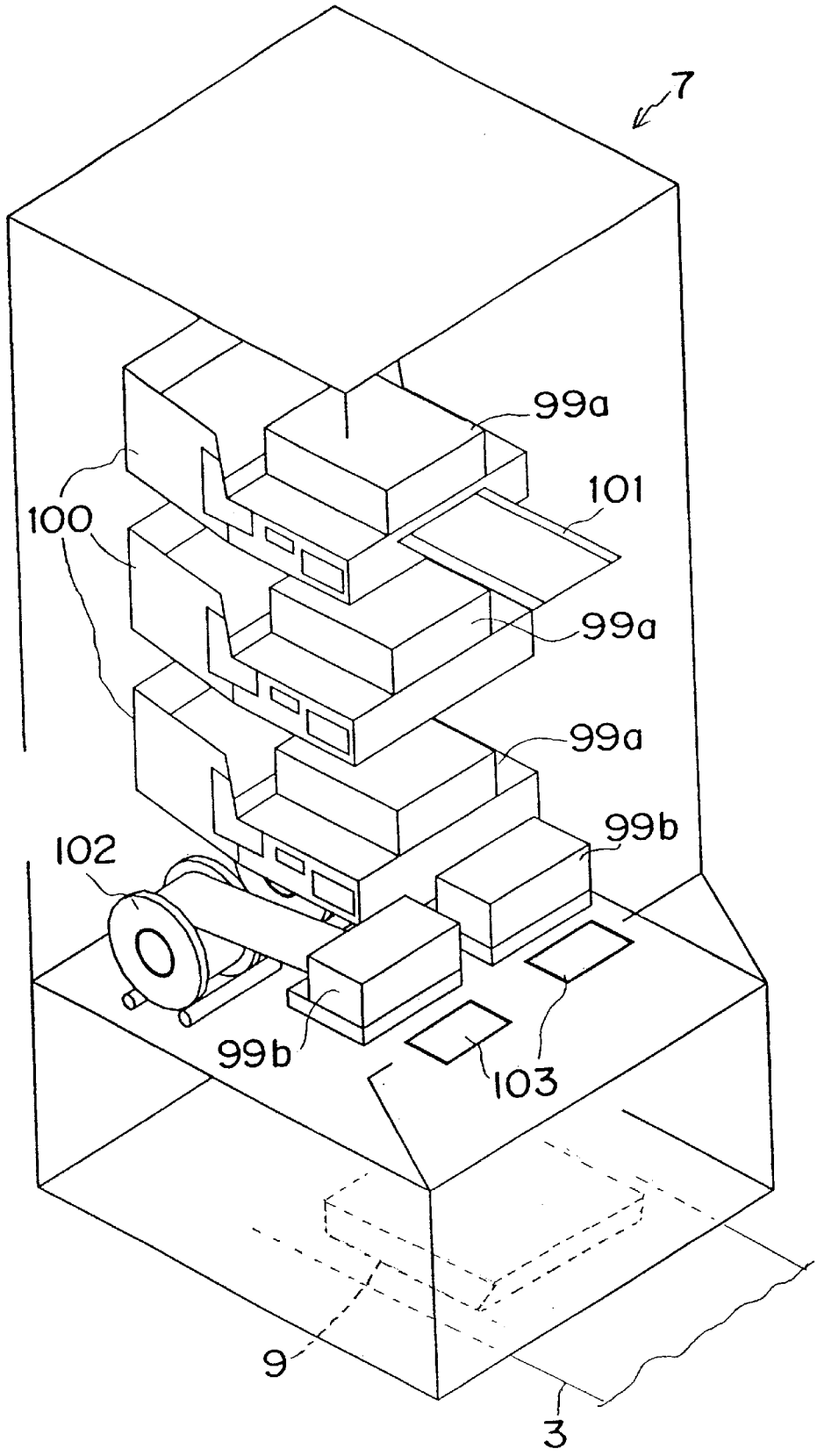
FIG. 16 is a schematic perspective view showing the label issuing station of FIG. 1.

The label issuing station 7 has a plurality of printers 99*a*, 99*b* arranged vertically as shown in FIG. 16, and the uppermost three printers 99*a* are fed with prescription paper 101 from stock storages 100, respectively. This prescription paper 101 is used for a pharmacist to later verify whether or not the dispensed medication is correct. Also, the printers 99*b* (shown juxtaposed below printers 99*a*) are each fed with a label 103 wound around a roll 102. This label 103 is affixed to the ampoules 67, storage containers or the like, and is used to indicate their contents.

<Tray Recovering Station>

Figure 17:
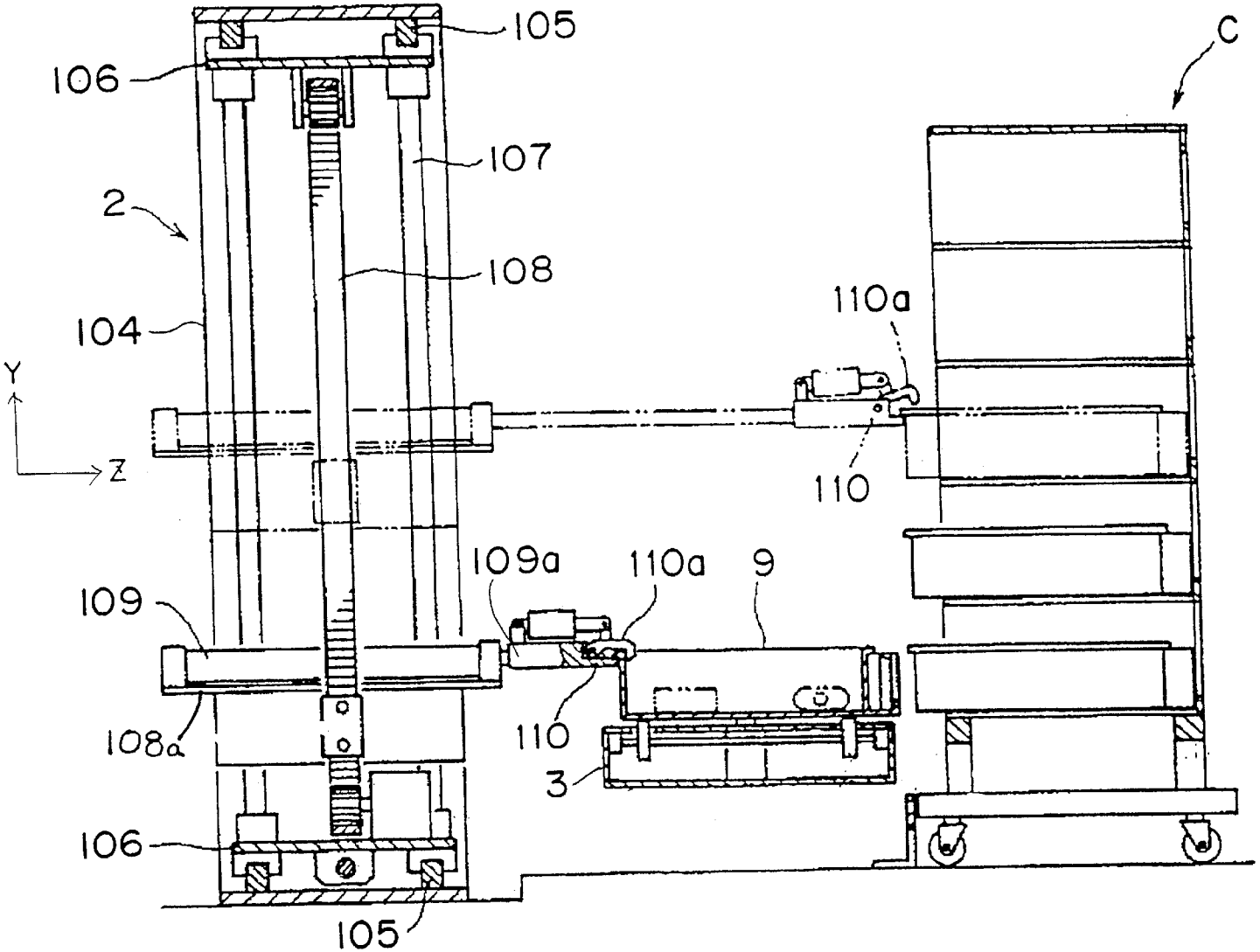
FIG. 17 is a sectional view showing the tray recovering station of FIG. 1.

In the tray recovering station 2, as shown in FIG. 17, a support base 106 is provided on rails 105 placed above and below in a support main frame 104 so that the support base 106 is reciprocatively movable along an X-axis direction parallel to the conveyor line 3. The support base 106 is equipped with guide rails 107 extending vertically. Base 108*a* is movable up and down along rails 107 by a belt chain 108 along a vertical Y-axis direction. Base 108*a* is equipped with a cylinder 109. Also, a rod 109*a* of the cylinder 109 is equipped with a gripping arm 110, which goes back and forth along a Z-axis direction perpendicular to the conveyor line 3. The gripping arm 110 has at its front end a claw portion 110*a* formed for gripping a peripheral portion of the tray 9 (see also Japanese Patent Laid-Open Publication HEI 9-51922 etc.).

<System Operation>

Next, operation of the medication collecting system constructed as described above is explained.

When patient prescription information is read, a tray 9 is fed out from the tray feed station 1 to the conveyor line 3. The tray 9 fed out to the conveyor line 3 is first conveyed to the tablet dispensing station 4. If information indicating that tablets 23 are not contained in the prescription information, then the tray 9 passes through the tablet dispensing station 4 without stopping. If such information is contained, the tray 9 is stopped below the sloped plate 57 of the distributing member 48.

For the prescription of the tablets 23, at the tablet dispensing station 4, one-day dose of medicaments are fed from the relevant tablet cassette 20 in steps of one dose one after another according to the dosage time, and then are packed into medication packages formed in the package belt 13.

Figure 18A:
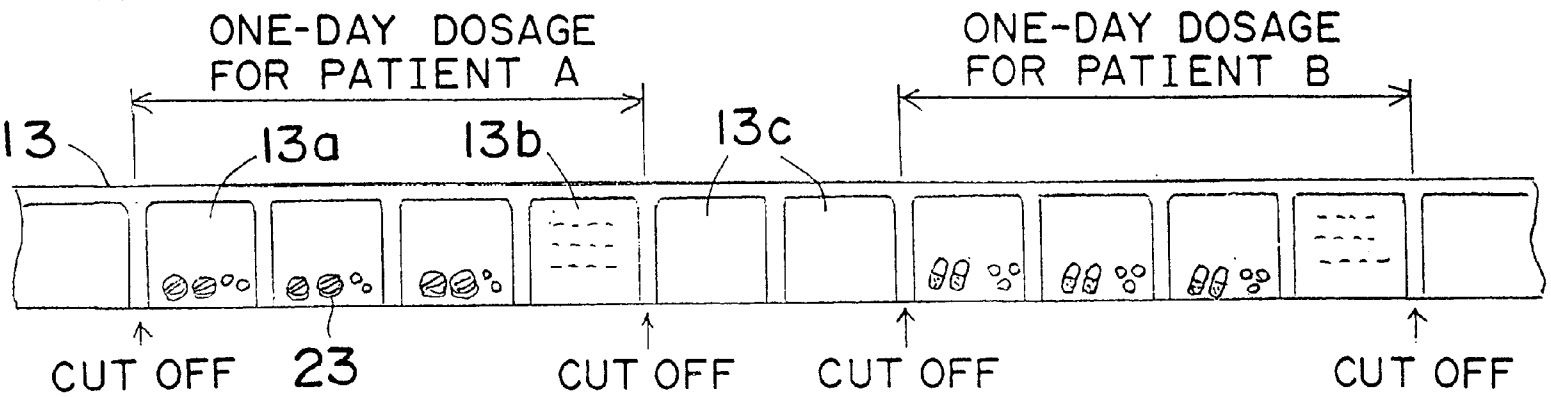
FIGS. 18A and 18B are front views showing examples of the package belt in which medicaments are packed.
Figure 18B:
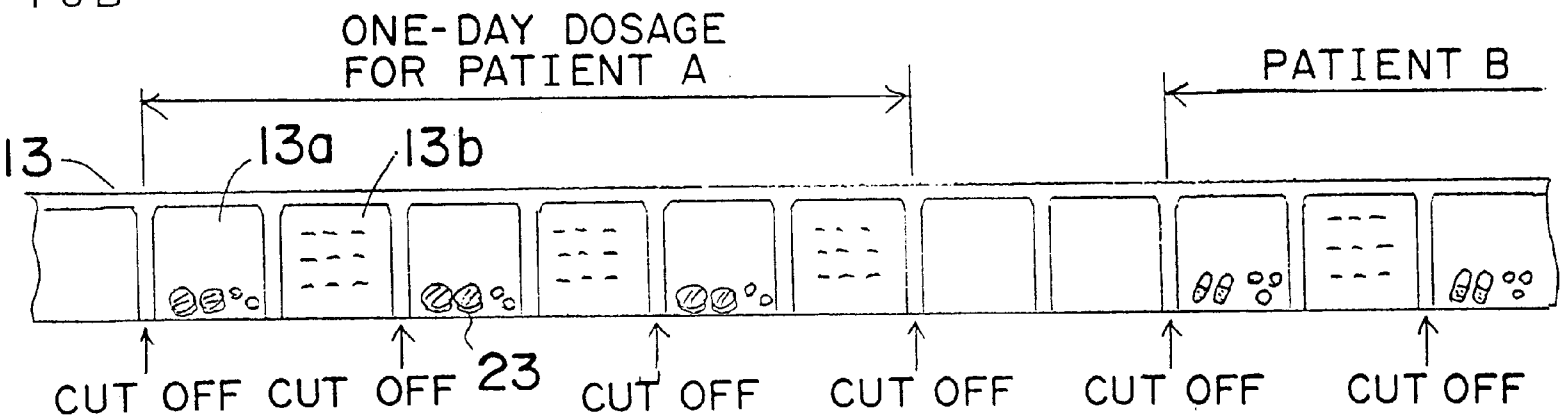

As for the form of package, if the one-day dosage includes a plurality of times, for example, morning, noon and evening, then medication packages 13*a* of the tablets 23 are continuously packaged as shown in FIG. 18A. Alternatively, empty packages are formed between the medication packages 13*a* of the tablets 23 and the contents of the tablets 23 dosage information and the like are printed on these empty packages to make printed portions 13*b* as shown in FIG. 18B. In the former case, as shown in FIG. 18A, the package belt is cut off by the cutter 29 with one-day doses taken as a unit. Thus, the need for bundling by the bundling machine 47 is eliminated. In the latter case, as shown in FIG. 18B, the package belt is cut off by the cutter 29 with one dose taken as a unit. In addition, with a different patient, two empty packages 13*c* are additionally formed between a printed portion 13*b* for patient A and a medication package portion 13*a* for the next patient B, thus enabling a continuous processing. Further, the empty packages 13*c* are separated from the other portions by the cutter 29.

Subsequently, the cut package belt 13 is conveyed to the inverting member 44 via the direction changing part 33 and the conveyor 34, so as to be transferred to the lifter 45. For the package belt 13 or the empty packages 13*c* in the unit of one-day doses, the lifter 45 goes up without waiting for stacking by the transfer from the inverting member 44; for the package belt 13 in the unit of one dose, the lifter 45 will not go up until one-day doses has been completely stacked by the transfer from the inverting member 44. Then, the cut package belt 13 is moved sideways by the feed-in member 46, where in the case of the package belt 13 or empty packages 13*c* in the unit of one-day doses, the cut package belt 13 is passed through as it is without being bundled by the bundling machine 47; in the case of the stacked package belt 13, the cut package belt 13 is once stopped at the bundling machine 47, where the cut package belt 13 is bundled and then fed to the tray 9 via the distributing member 48. In addition, in the distributing member 48, for processing's sake, when empty packages 13*c* are conveyed up, the empty packages 13*c* are discarded to the dust box 63 via the opening 58 by rotating the distributing plate 59.

Subsequently, the tray 9 is conveyed to the array ampoule dispensing station 5, and further to the random ampoule dispensing station 6. In this case also, based on the prescription information, the tray 9 is passed through as it is, or when ampoules 67, 81 are fed, the tray 9 is stopped at a relevant unit.

After that, the tray 9 is conveyed to the label issuing station 7. In the label issuing station 7, the prescription paper 101 on which prescription information as to all the medicaments within the conveyed-up tray 9 has been printed, as well as a label 103 to be affixed to the surface to show the contents of the stored ampoules 67 are fed into the tray 9.

Now that desired medicaments have been fed to the tray 9 in this way, this tray 9 is conveyed to the tray recovering station 2, where the medicaments are transferred onto shelves of a sorting cart (e.g., medication storage cabinet marketed by Pyxis Co.) C by the arm 110. In addition, this sorting cart C is movably set in the nurse station, and put into use for distribution to the patients in hospital when administration time has come.

<Medication Replenishment Operation>

Whereas the dispensing of medication is carried out as described above, the medication collecting system is enabled to detect the absence of the tablets 23, the ampoules 67, 81, and to perform appropriate replenishment by checking these medicaments.

For this purpose, the tablet dispensing station 4 and the ampoule dispensing stations 5, 6 are equipped, although not shown, with a touch panel to be controlled by a controller, a wireless barcode reader with a recharging cradle therefor, and a scale.

Figure 19A:
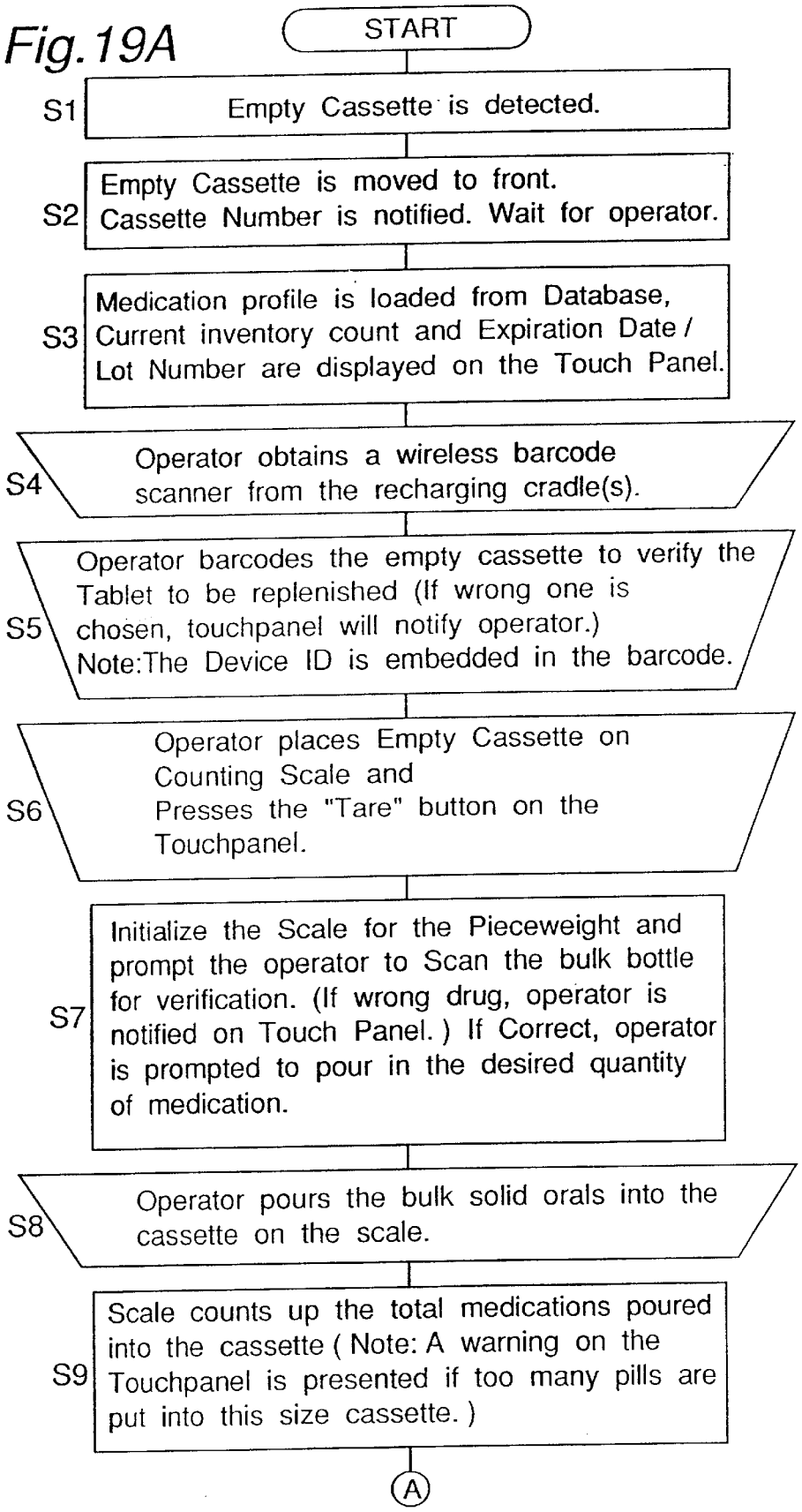
FIGS. 19A and 19B are flow charts showing the tablet replenishing work in the tablet dispensing station.
Figure 19B:
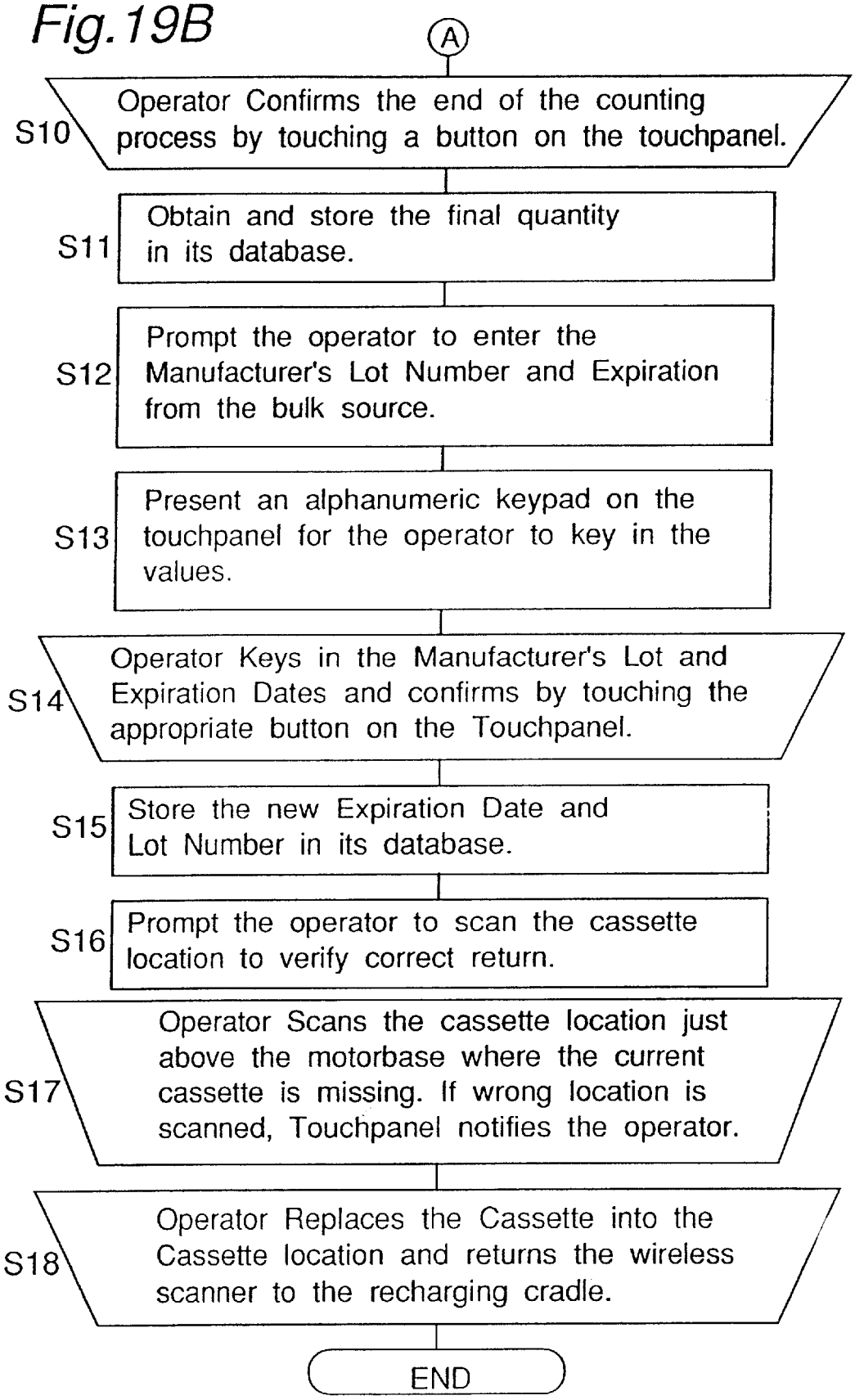

In the tablet dispensing station 4, the tablet cassettes 20 are exchanged according to the flow charts of FIGS. 19A and 19B. That is, when specified tablets 23 have come out of stock so that an empty tablet cassette 20 is detected (step S1), the cylindrical drum 18 is rotated so that the empty tablet cassette 20 is moved to an interchangeable position, where its cassette number is notified, followed by a standby state (step S2). Also, a relevant medication profile is loaded from the database, and the current inventory count and expiration dates/lot numbers are displayed on the touch panel (step S3). Then, the operator obtains a wireless barcode scanner (step S4), reads the barcode of this tablet cassette 20, verifying tablets 23 to be replenished (step S5) In this process, if the selected tablet cassette 20 is other than one containing the correct tablets 23, the operator is informed of an error by the touch panel.

Subsequently, the operator places the empty tablet cassette 20 on the scale, where if the operator presses the "Tare" button on the touch panel (step S6), then the scale is initialized, prompting the operator to operate the bulk bottle for verification (step S7). If the verified bulk bottle is erroneous, the result is displayed on the touch panel, by which the operator is reported of it. If the verification result is correct, then the operator is prompted to pour in a desired quantity of medication into the scale. Then, if the operator has poured oral medication into the tablet cassette 20 on the scale (step S8), the scale counts the total medications poured into the tablet cassette 20 (step S9) In this case, if too much medication is poured in, a warning is presented on the touch panel.

Next, the operator operates a button on the touch panel, where if an end of the counting process is confirmed (step S10), then the final quantity is stored in the database (step S11). Subsequently, the operator is prompted to enter the manufacturer's lot number and expiration date according to the indication on the bulk bottle (step S12). Also, an alphanumeric keypad is displayed on the touch panel for the operator to key in values (step S13). If the operator has keyed in the manufacturer's lot number and expiration date and confirmed by touching an appropriate button on the touch panel (step S14), then the database is updated so that the lot number and expiration date are rewritten to the new ones (step S15).

After that, in order to verify a correct return place for the replaced tablet cassette 20, the operator is prompted to scan the barcode of cassette location (step S16), and this is displayed on the touch panel. The operator sets a new tablet cassette 20 according to this instruction, where the operator scans the barcode of the cassette location provided just above the motor base 19 with no tablet cassette 20 set. If a barcode of a wrong position is scanned, this fact is displayed on the touch panel so that the operator is notified of it (step S 17). With these steps of work completed, the operator sets the tablet cassette 20 to the motor base 19 in the corresponding position, and returns the wireless scanner to the original position (step S18).

Figure 20A:
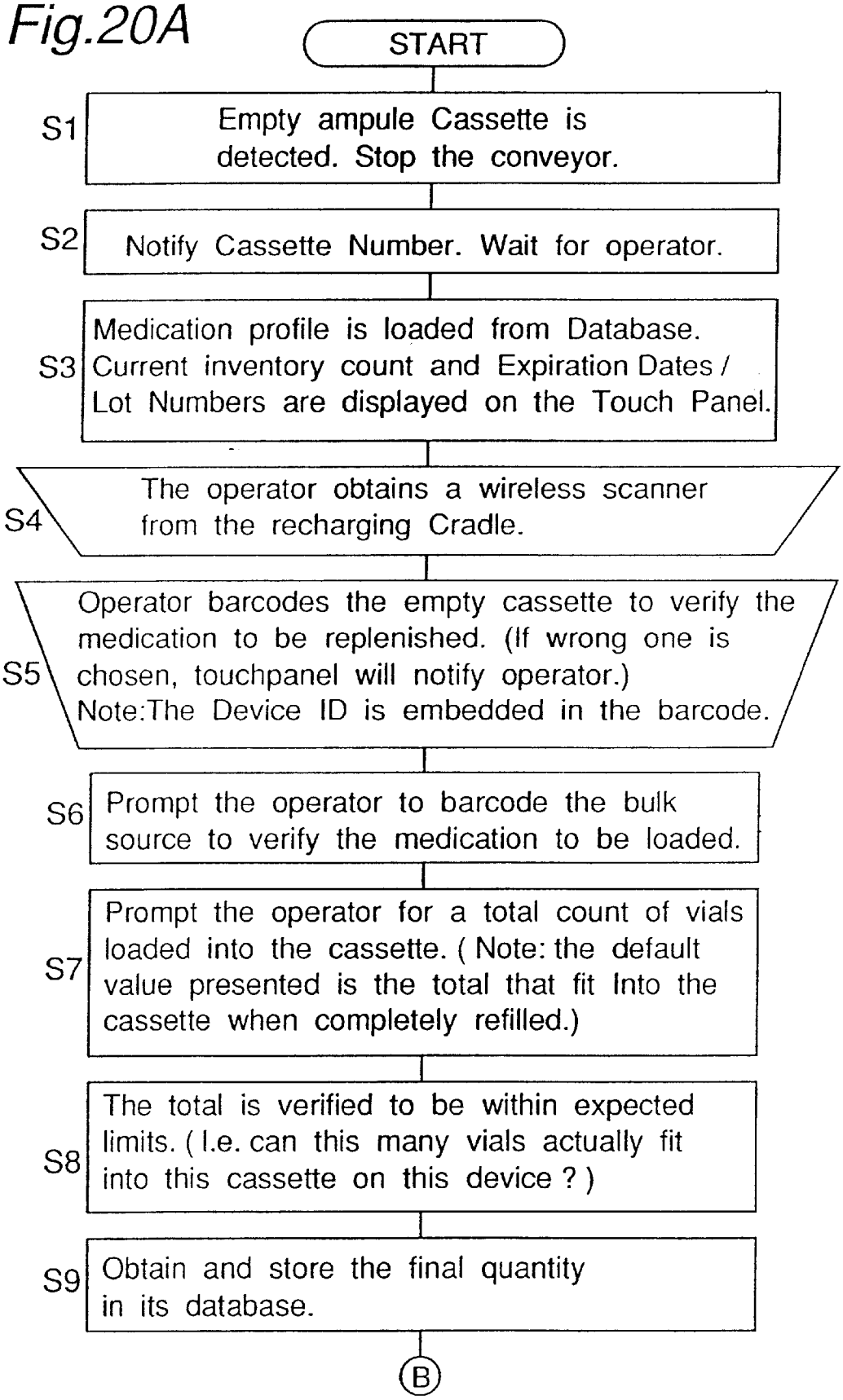
FIGS. 20A and 20B are flow charts showing the ampoule replenishing work in the array ampoule dispensing station or random ampoule dispensing station.
Figure 20B:
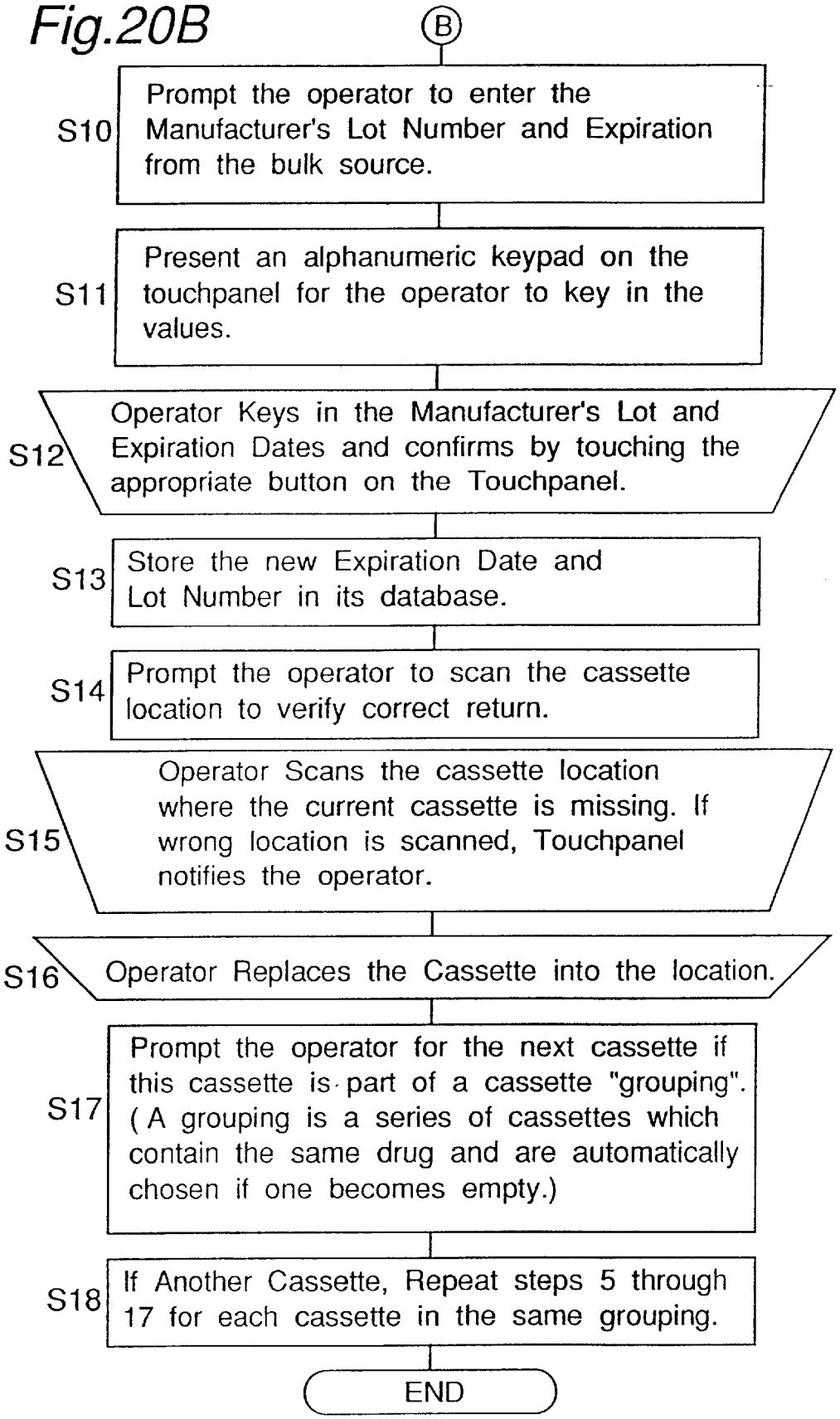

It is noted that, also for the ampoule cassettes 69 and the ampoule containers 82, the processes described above are carried out similarly according to the flow charts shown in FIGS. 20A and 20B.

<Consumables Management Operation>

Also, in this medication collecting system, even consumption state of consumable articles (printing ink, package belt and the like) in the units can be detected.

For example, the remaining quantity of the package belt 13 which is used in the tablet dispensing station 4 is calculated based on an initial length and a length required per package. Similarly, the remaining quantity of the band set to the bundling machine 47 which is used in the tablet dispensing station 4 is calculated based on an initial length and a band feed quantity. Further, remaining quantity of the prescription paper 101 which is used in the label issuing station 7 is calculated by subtracting the number of printed sheets from the initial setting number of sheets each time a printing process is performed. The remaining quantity of thermal transfer ink ribbon which is used in the label issuing station 7 is calculated based on an initial length and a consumption length (the consumption length for six-line printing is 3.5 mm).

Each time the consumption state of each consumable article is detected in this way, consumable article data is updated, where it is decided whether or not the article needs to be replaced. If it is decided that the article needs to be replaced, then an instruction that, for example, "Package paper will soon be out. Do you want to replenish?", and "YES/NO" keys are displayed on the display as a replenishment operating screen. If the "YES" key is chosen, then replacement procedure for the relevant consumable article is displayed. Then, the article is replaced according to this procedure, and if the replacement is completed, a question, "Has replacement been completed?", and "YES/NO" keys are automatically displayed. If the "YES" key is chosen, the replenishment operating screen is ended and consumable article data is updated, followed by a return to the normal screen.

<Automatic Bagging Station>

Figure 21:
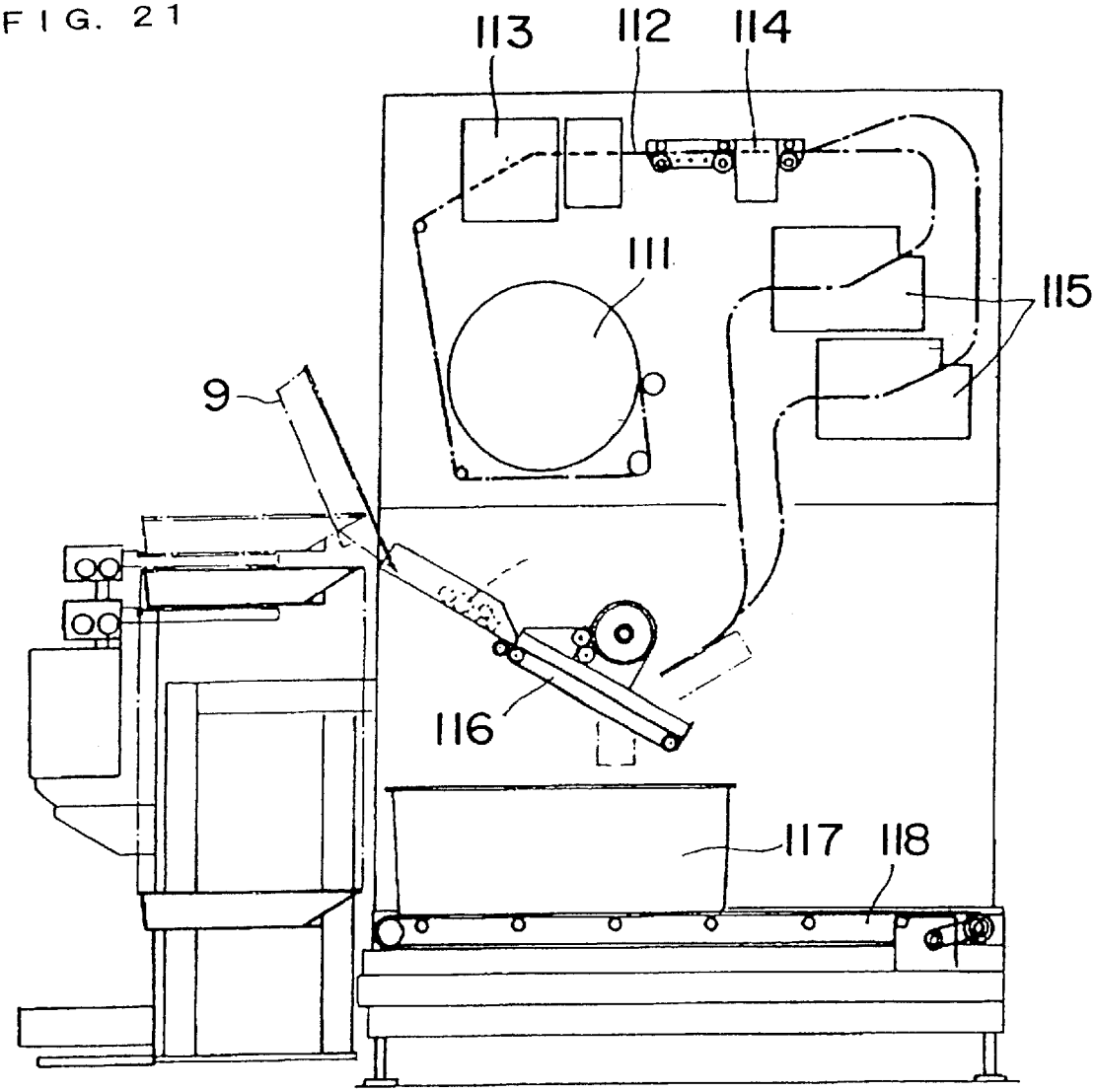
FIG. 21 is a schematic sectional view of an automatic packing station that can be provided instead of the tray recovering station of FIG. 17.

Whereas the tray recovering station 2 is provided in the above-described embodiment, an automatic bagging station shown in FIG. 21 may be adopted instead (for more details, see Japanese Patent Applications HEI 10-203749, HEI 10-75813, etc.).

In this automatic bagging station, a sheet 112 wound around a roll 111 is formed into a bag shape by a sealing part 113 and cut into bags by a cutter 114, and the bags are printed on the surfaces by a printer 115 and then conveyed to a medication feed part 116. In the medication feed part 116, with the bags opened, medicaments within the tray 9 are all put into the bags, and after sealing, the bags are accommodated in a large-size tray 117 provided below the medication feed part 116. The large-size tray 117 is conveyed sideways by a conveyor 118.

Although an embodiment of the present invention has been described above with reference to the accompanying drawings, modifications and changes apparent for those skilled in the art may be made in various ways. It is needless to say that these modifications and changes should be construed as being included in the present invention unless they depart from the spirit or scope of the invention.

We claim:

1. A medication dispensing apparatus for storing a plurality of different types of oral solid medication and for dispensing doses of the medication for a patient in packaged, patient-specific medication dosage units in accordance with patient-specific prescription information comprising:

means for storing the different types of oral solid medication;

means for selectively dispensing doses of the oral solid medication from the storing means for the patient;

means for packaging each dispensed dose for the patient as a separate patient-specific medication dosage unit in a package formed in a continuous package belt such that each dosage unit for the patient is arranged in the package belt as (1) a group of dosage units, or (2) a single dosage unit;

means for selectively cutting the package belt containing the patient's oral solid medication into discrete sections such that each group of dosage units for the patient is separated into a section and each single dosage unit for the patient is separated into a section;

means for stacking at least each single dosage unit section for the patient; and means for bundling at least each stacked single dosage unit for the patient.

2. The medication dispensing apparatus of claim 1 wherein the cutting means separates the package belt into at least one dosage unit section corresponding to the day the at least one dosage unit of medication is to be taken.

3. The medication dispensing apparatus of claim 1 wherein the cutting means separates the package belt into at least one dosage unit section corresponding to the time of day that the at least one dosage unit of medication is to be taken.

4. The medication dispensing apparatus of claim 1 further including:

means for printing prescription information on the package belt; and each dosage unit is packaged such that each discrete package belt section includes at least one empty package and the printing means prints patient-specific prescription information on the empty package.

5. The medication dispensing apparatus of claim 1 wherein each dosage unit is further packaged such that an empty package is provided between dosage units of different patients and the cutting means separates the empty package from the dosage unit sections.

6. An automated medication dispensing system for dispensing dosage units of oral solid and liquid medication for patients in accordance with patient prescription information, the system comprising:

a medication-receiving tray for each patient;

a conveyor for transporting the tray about the system;

at least one oral solid medication dispenser disposed along the conveyor for dispensing a packaged dosage unit of oral solid medication into the patient's tray if required by the patient prescription information, the dispenser including:

a medication feed device having:

a plurality of oral solid medication storage containers, each container adapted to store one of a plurality of medication types and to dispense dosage units of the medication in a predetermined manner;

metering apparatus operatively connected to each storage container and adapted to dispense the dosage units of medication from each storage container; and at least one passageway forming a guide directing the dispensed medication from the storage containers to a packaging device;

a packaging device having:

a continuous source of package belt material onto which the dispensed medication is directed from the passageway;

an information-adding device positioned adjacent the package belt material for supplying printed information to the package belt material corresponding to the patient prescription information; and a sealer for sealing the package belt material into separate medication packages, each package enclosing a dosage unit of medication;

a cutting device having a cutter adjacent the sealed package belt for engaging the package belt material and cutting the package belt material in a predetermined manner into discrete sections, each section including at least one medication package containing a dosage unit of medication; and at least one liquid medication dispenser disposed along the conveyor and spaced from the oral solid medication dispenser for discharging a packaged dosage unit of liquid medication into the patient's tray if required by the patient prescription information, the dispenser including storage apparatus adapted to store a plurality of different types of liquid medication in a packaged, dosage unit form and discharge apparatus adapted to discharge the packaged, dosage unit liquid medication into the patient's tray.

7. The medication dispensing system of claim 6 further including a tray feed station along a first end of the conveyor upstream of the oral solid and liquid medication dispensers for feeding the tray onto the conveyor.

8. The medication dispensing system of claim 7 wherein the tray feed station includes:

a housing for receiving and storing a plurality of stacked trays, the housing having walls forming a first opening for receiving the trays and a second opening for discharging the trays onto the conveyor;

at least one pivotable feed claw disposed in the housing having a first position for supporting a lowermost stacked tray and a second position for discharging the lowermost tray onto the conveyor; and a motor coupled to the at least one feed claw for pivoting the at least one feed claw between the first and second positions;

whereby, the trays may be discharged from the tray feed station, one after the other, onto the conveyor.

9. The medication dispensing system of claim 7 further including a tray recovery station for recovering and sorting each tray containing the medication for each patient.

10. The medication dispensing system of claim 6 wherein the metering apparatus includes:

a motorized base operatively connected to each storage container for actuating the containers to discharge the medication in a predetermined manner based on the patient prescription information; and a sensor for detecting the amount of medication dispensed from each storage container.

11. The medication dispensing system of claim 6 wherein the passageway further includes at least one hopper having an upper opening positioned to receive the medication from the passageway and a lower opening positioned to direct the dispensed medication toward the packaging device.

12. The medication dispensing system of claim 6 wherein the information-adding device is a printer for printing the patient prescription information directly on the package belt material.

13. The medication dispensing system of claim 6 wherein the oral solid medication dispenser further includes:

a stacking mechanism downstream of the cutting device for receiving the cut package belt sections and for stacking the cut package belt sections; and a bundling mechanism for bundling the stacked package belt sections.

14. The medication dispensing system of claim 13 further including a distributing mechanism for discharging the bundled package belt sections to the patient's tray.

15. The medication dispensing system of claim 12 further including at least a second printer for printing patient prescription information on a prescription paper and for discharging the printed paper into the patient's tray.

16. The medication dispensing system of claim 15 wherein the printed prescription information includes instructions for taking the medication.

17. The medication dispensing system of claim 6 wherein the at least one liquid medication dispenser is a random-storage ampoule dispenser which includes:

a plurality of liquid medication random ampoule storage containers each adapted to store an array of ampoules corresponding to one of the plurality of liquid medication types, each storage container having walls forming an opening through which the ampoules are metered out in a controlled manner;

liquid medication ampoule metering apparatus for metering a predetermined quantity of the ampoules from each storage container;

a collector apparatus for receiving ampoules from the metering apparatus and for transporting the ampoules to an ampoule staging device; and an ampoule staging device having an opening for receiving ampoules from the collector apparatus and walls forming a gated opening through which the ampoules are discharged to the patient's tray.

18. The medication dispensing system of claim 17 wherein the storage containers include:

a storage chamber for storage of the ampoules in a random manner;

a conveyor for transporting ampoules from each chamber to a discharge chute; and a discharge chute for discharging the ampoules from the conveyor to the collector.

19. The medication dispensing system of claim 17 wherein the collector apparatus includes:

a moveable lifter container for receiving the ampoules from the discharge chutes, the lifter having funnel-shaped walls forming a top opening through which the ampoules are received and a shuttered bottom opening through which the ampoules are discharged;

moveable shutters positioned across the lifter bottom opening having a first position covering the opening and a second position away from the opening so that ampoules in the lifter can be discharged into the staging device when the shutters are in the second position; and lift apparatus for raising and lowering the lifter so that the discharge chutes are substantially aligned with the lifter top opening prior to discharge of an ampoule from a discharge chute and for positioning the lifter adjacent the staging device so that ampoules in the lifter are discharged from the lifter into the staging device.

20. The medication dispensing system of claim 6 wherein the at least one liquid medication dispenser is an array ampoule dispenser which includes:

a plurality of liquid medication ampoule storage containers each adapted to store an array of ampoules corresponding to one of the plurality of liquid medication types, each storage container having walls forming an opening through which the ampoules are metered out in a controlled manner;

liquid medication ampoule metering apparatus for dispensing a predetermined quantity of ampoules from each storage container;

conveyor apparatus for receiving ampoules from the metering apparatus and transporting the ampoules to an ampoule container; and an ampoule container having at least one wall defining an opening for receiving ampoules from the conveyor apparatus, said container directing the ampoules to the patient's tray.

21. The medication dispensing system of claim 20 wherein the conveyor apparatus includes:

at least one loading conveyor for receiving ampoules metered out from the ampoule storage containers; and a collecting conveyor for receiving ampoules from the at least one loading conveyor and for transporting the ampoules to the ampoule container.

22. The medication dispensing system of claim 20 further including at least a second liquid medication dispenser disposed along the conveyor which is a random-storage ampoule dispenser including:

a plurality of liquid medication random ampoule storage containers each adapted to store an array of ampoules corresponding to one of the plurality of liquid medication types, each storage container having walls forming an opening through which the ampoules are metered out in a controlled manner;

liquid medication ampoule metering apparatus for metering a predetermined quantity of the ampoules from each storage container;

a collector apparatus for receiving ampoules from the metering apparatus and for transporting the ampoules to an ampoule staging device; and an ampoule staging device having an opening for receiving ampoules from the collector apparatus and walls forming a gated opening through which the ampoules are discharged to the patient's tray.

23. The medication dispensing system of claim 22 further including a tray feed station along a first end of the conveyor upstream of the oral solid and liquid medication dispensers for feeding the patient's tray onto the conveyor.

24. The medication dispensing system of claim 23 further including a tray recovery station along a second end of the conveyor downstream of the oral solid and liquid medication dispensers for recovering the patient's tray containing the medication.

25. The medication dispensing system of claim 24 further including at least one printer for printing patient-specific prescription information on a prescription paper and for discharging the paper including the printed information to the patient's tray.

26. A medication dispensing apparatus for storing a plurality of different types of oral solid medication and for dispensing the medication in packaged, patient-specific medication dosage units in accordance with patient prescription information comprising:

a plurality of oral solid medication storage containers, each container adapted to store one type of the plurality of medication types;

a motorized unit associated with each container adapted to direct doses of medication from each storage container to a medication guide;

the medication guide has a first end positioned to receive the medication doses, a second end positioned adjacent a packaging mechanism and a guide therebetween;

the packaging mechanism includes a source of package belt material, said package belt material being positioned to receive the dispensed medication dose from the guide, and a sealer adapted to seal the package belt to form a separate package in the package belt for each dosage unit received by the package belt, each dosage unit being arranged in the package belt as (1) a group of dosage units, or (2) as a single dosage unit, a cutting mechanism having a cutting member positioned adjacent the sealed package belt, the cutting member adapted to cut the package belt into discrete sections such that each group of dosage units is separated into a section and each single dosage unit is separated into a section;

a stacking mechanism positioned to receive the cut package belt sections and to stack at least the single dosage unit sections;

a bundling mechanism adapted to place a band around at least the stacked single dosage unit sections, thereby joining said dosage unit sections into a bundle; and a distributing mechanism positioned adjacent the bundling mechanism including a guide having a receiving end, a terminal end and a guide surface therebetween along which the dosage unit sections are directed to a patient receptacle.

27. The medication dispensing apparatus of claim 26 wherein the cutting mechanism separates the package belt into at least one dosage unit section corresponding to the day the at least one dosage unit of medication is to be taken.

28. The medication dispensing apparatus of claim 26 wherein the cutting mechanism separates the package belt into at least one dosage unit section corresponding to the time of day that the dosage unit of medication is to be taken.

29. The medication dispensing apparatus of claim 26 further including:

a printer adjacent the package belt and adapted to print prescription information on the package belt; and each dosage unit is packaged such that there is an empty package associated with each dosage unit and the printer prints prescription information on the empty package.

30. The medication dispensing apparatus of claim 26 wherein:

the packaging mechanism provides an empty package between dosage units for different patients;

the cutting mechanism separates the empty package from between the dosage units;

the distributing mechanism guide surface is a downwardly-sloped surface having an opening in communication with a waste receptacle;

the waste receptacle is positioned below the guide surface;

a distributing plate is movably mounted along the guide surface across the opening, said plate being movable between a first position in which the plate closes the opening so that each dosage unit section is directed along the surface to the patient receptacle and a second position in which the plate is positioned away from the opening so that each empty package is directed to fall through the opening and into the waste receptacle; and a motor is connected to the plate through a linkage for moving the plate between the first and second positions.

31. The medication dispensing apparatus of claim 26 wherein the apparatus further includes:

conveyor apparatus adapted to deliver each dosage unit section corresponding to a patient to the stacking mechanism;

the stacking mechanism includes a stacker mounted for movement between a first position in which the stacker receives the delivered dosage unit section and a second position in which the stacker places said dosage unit section on a stacking surface such that at least one dosage unit section corresponding to a group of dosage units is placed on the stacking surface and the single dosage unit sections are stacked one on top of the other on the stacking surface; and a transfer member positioned adjacent to the stacking surface and mounted for movement between at least a first position in which stacked dosage unit sections are moved from the stacking surface to the bundling mechanism and a second position in which the unstacked dosage unit sections and bundled dosage unit sections are moved to the distributing mechanism.

32. A medication dispensing apparatus for storing a plurality of different types of oral solid medication and dispensing doses of the medication in packaged, patient-specific medication dosage units in accordance with patient-specific prescription information, the apparatus comprising:

means for storing the oral solid medication;

means for dispensing doses of the oral solid medication from the storing means;

means for packaging each dispensed dose as a separate dosage unit in a package formed in a continuous package belt such that each dosage unit is arranged in the package belt as (1) a group of dosage units, or (2) as a single dosage unit and an empty package is provided between dosage units for different patients;

means for cutting the package belt into discrete sections such that each group of dosage units is separated into a section and each single dosage unit is separated into a section and the empty package is separated from between the dosage units;

means for stacking at least each single dosage unit section;

means for bundling at least each stacked single dosage unit section; and means for distributing the section corresponding to the group of dosage units and each bundled single dosage unit section to a first receptacle and for distributing the empty package to a second receptacle.

33. The medication dispensing apparatus of claim 32 wherein the storing means is a cassette and the dispensing means comprises a motor base associated with each cassette.

34. The medication dispensing apparatus of claim 32 further including means for guiding the dispensed doses from the storing means to the packaging means.

35. The medication dispensing apparatus of claim 32 wherein the medication dispensing apparatus further includes:

means for moving each dosage unit section for a patient to the stacking means;

the stacking means places said patient's dosage unit sections on a stacking surface such that at least one section corresponding to a group of dosage units is placed on the stacking surface and the single dosage unit sections are stacked one on top of the other on the stacking surface; and means for moving stacked dosage unit sections to the bundling means and unstacked and bundled dosage unit sections to the distributing means.

36. The medication dispensing apparatus of claim 32 wherein:

the stacking means separately places the empty package on the stacking surface; and the moving means moves the empty package from the stacking surface to the distributing means.

37. The medication dispensing apparatus of claim 32 wherein the distributing means comprises:

a downwardly-sloped guide surface having an upper end adapted to receive each dosage unit section and empty package, a lower end adjacent the first receptacle, an opening in the surface in communication with the second receptacle, said second receptacle being positioned below the guide surface;

a distributing plate movably mounted between a first position in which the plate closes the opening so that each dosage unit section is directed along the guide surface to the first receptacle and a second position in which the plate is positioned away from the opening so that each empty package is directed to fall through the opening and into the second receptacle; and means for moving the plate between the first and second positions.

38. A medication dispensing apparatus for storing a plurality of different types of oral solid medication and for dispensing the medication in packaged, patient-specific medication dosage units in accordance with patent-specific prescription information comprising:

means for storing oral solid medication;

means for dispensing the oral solid medication from the medication storing means in patient-specific dosage units in accordance with the patient specific prescription information;

means for packaging the oral solid medication in separate medication packages formed in a package belt, each medication package representing a patent-specific medication dosage unit;

cutting means for cutting the package belt into discrete sections, each section including at least one medication package and at least some of the sections having plural medication packages in accordance with the patient-specific prescription information;

stacking means for stacking the cut package belt sections for each patient; and bundling means for bundling the stacked package belt sections; and distributing means for separately distributing the package belt sections and empty packages;

wherein empty packages are formed between the medication packages of different patients by the packaging means and wherein the empty packages are cut and separated from other medication packages by the cutting means, passed through both the stacking means and the bundling means without being stacked and bundled and then distributed by the distributing means separately from the other stacked package belt sections.

39. The medication dispensing apparatus of claim 38 wherein the distributing means comprises a sloped plate having an opening and a distributing plate which opens and closes the opening, whereby when the distributing plate closes the opening, the stacked package belt sections can be dispensed along the sloped plate, while when the distributing plate opens the opening, the empty packages can be discarded through the opening.

* * * * *

UNITED STATES PATENT AND TRADEMARK OFFICE

CERTIFICATE OF CORRECTION

PATENT NO. : 6,625,952 B1
DATED : September 30, 2003
INVENTOR(S) : Chudy et al.

It is certified that error appears in the above-identified patent and that said Letters Patent is hereby corrected as shown below:

Title page,
Item [73], Assignee, after "AutoMed Technologies, Inc., Vernon Hills, IL (US)" add -- ; Yuyama Mfg. Co., Ltd., Toyonaka (JP) --.

Signed and Sealed this

Twenty-second Day of June, 2004

JON W. DUDAS
*Acting Director of the United States Patent and Trademark Office*